US007059712B2

(12) United States Patent
Matsuzaki et al.

(10) Patent No.: US 7,059,712 B2
(45) Date of Patent: Jun. 13, 2006

(54) INKJET RECORDING APPARATUS

(75) Inventors: Tetsuya Matsuzaki, Fukuoka (JP); Shinichi Kitamura, Fukuoka (JP); Hiroyuki Matsuba, Fukuoka (JP); Kensei Otsubo, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/087,751

(22) Filed: Mar. 24, 2005

(65) Prior Publication Data

US 2005/0162488 A1 Jul. 28, 2005

Related U.S. Application Data

(62) Division of application No. 10/387,558, filed on Mar. 14, 2003, now Pat. No. 6,929,358, which is a division of application No. 09/811,631, filed on Mar. 20, 2001, now Pat. No. 6,582,067.

(30) Foreign Application Priority Data

Mar. 21, 2000 (JP) ..... 2000-77434
Mar. 22, 2000 (JP) ..... 2000-80461
Mar. 24, 2000 (JP) ..... 2000-84867

(51) Int. Cl.
*B41J 2/175* (2006.01)

(52) U.S. Cl. ..... 347/85

(58) Field of Classification Search ..... 347/84, 347/85, 86, 87; 141/2, 18
See application file for complete search history.

(56) References Cited

U.S. PATENT DOCUMENTS

| | | | | |
|---|---|---|---|---|
| 4,506,277 | A | 3/1985 | Terasawa | |
| 4,528,576 | A * | 7/1985 | Koumura et al. | 347/15 |
| 4,908,638 | A * | 3/1990 | Albosta et al. | 347/43 |
| 4,999,651 | A | 3/1991 | Duffield et al. | |
| 5,619,237 | A | 4/1997 | Inoue et al. | |
| 6,033,064 | A | 3/2000 | Pawlowski et al. | |
| 6,142,597 | A | 11/2000 | Kogami | |
| 6,582,067 | B1 | 6/2003 | Matsuzaki et al. | |

FOREIGN PATENT DOCUMENTS

JP 57-210879 12/1982

* cited by examiner

*Primary Examiner*—Anh T. N. Vo
(74) *Attorney, Agent, or Firm*—Wenderoth, Lind & Ponack, L.L.P.

(57) ABSTRACT

An inkjet recording apparatus ejects ink from recording heads to a recording paper, thereby attaching the ink to the medium for recording. The apparatus includes a carriage driving motor, a transfer motor, a scanner which reciprocates a carriage having the recording heads in a scanning direction, and a transfer machine. The transfer machine transfers the recording paper in a transfer direction perpendicular to the scanning direction. Both of the motors are located at approximately the same place in an ejecting direction of ink from the heads to the paper, and at the same height of a transfer path of the paper or on the carriage side with respect to the transfer path.

15 Claims, 17 Drawing Sheets

INKJET RECORDING APPARATUS

This application is a divisional application of application Ser. No. 10/387,558, filed Mar. 14, 2003 now U.S. Pat. No. 6,929,358, which is a divisional application of application Ser. No. 09/811,631, filed Mar. 20, 2001 now U.S. Pat. No. 6,582,067.

FIELD OF THE INVENTION

The present invention relates to an inkjet recording apparatus which ejects ink from a recording head to a recording medium and attaches the ink onto the medium, thereby performing the recording.

BACKGROUND OF THE INVENTION

Conventionally, an inkjet recording apparatus, which ejects ink from a recording head to a recording medium and attaches the ink onto the medium, thereby performing the recording, has been known in the market.

In this conventional apparatus, a carriage to which the recording head is mounted reciprocates in a scanning direction, while the recording medium, such as a sheet of paper, is transferred in a direction perpendicular to the scanning direction. Positions of the recording head and the recording paper, as well as the ejection of the ink from the head, are controlled, so that the ink is attached to a specified position on the recording paper for recording. In this apparatus, a carriage driving motor, as a driver, reciprocates the carriage in the scanning direction, while a transfer motor, as a driver, transfers the recording paper in a transfer direction.

High speed recording is demanded for the inkjet recording apparatus, while downsizing the apparatus is also required. For realizing the high speed recording, the carriage and the recording paper must move at high speed. For instance, it is desirable to employ a high-power carriage driving motor and a high-power transferring motor. However, the high-power motor needs a larger outer diameter or a longer length along a rotating axis, so that a size of the motor is necessarily be bulky.

On the other hand, on a transfer path of the recording paper or in a travel space where the carriage reciprocates, no components should be placed. Thus, these motors must be placed outside of the transfer path and travel space, and a large additional space must be provided for disposing these motors. As a result, high-speed recording is achieved at the cost of increasing the size of the apparatus.

As such, the inkjet recording apparatus has encountered contradictory requirements, i.e., high-speed recording and downsizing.

Isn order to solve the problem of these contradictory requirements, the following structure is designed. The carriage and an ink-tank are coupled to each other with ink supplying tubes, and the ink-tank is disposed outside of the carriage. Ink in the ink-tank is supplied to recording heads of the carriage via the tubes. However, even for an apparatus with this structure, it is very difficult to dispose the tubes so that the ink can be supplied in a stable manner for recording at high-speed, e.g., ink ejecting frequency is not less than 18 kHz.

When these tubes are bent with a curvature as small as an electric wiring can be bent, the flowing path is bent and damaged. The smaller the diameter of the tube, the smaller the curvature that the tube can be bent. However, the resistance in the flowing path against the ink increases due to narrowing the diameter of the tube.

Therefore, these tubes are desirably disposed with rather larger curvatures, which, however, requires a larger space and results in a bulky apparatus.

Even if the tubes are disposed with rather larger curvatures, the carriage is placed at a distance from the ink-tank, so that the tubes must be long. This results in greater resistance from the flow-path against the flowing ink, so that the ink cannot be supplied in a stable manner. In addition to this, the distant placing of the ink-tank from the carriage invites a bulky apparatus. Further, narrower and longer tubes yield a greater flow path resistance against the flowing ink, which prevents high-speed printing.

SUMMARY OF THE INVENTION

The present invention addresses the problem discussed above, and aims to provide an inkjet recording apparatus in which the two contradictory requirements, i.e., high-speed recording and downsizing, are compatible.

The inkjet recording apparatus of the present invention comprises recording heads mounted to a carriage and ejecting plurality of colored inks, ink tanks for pooling ink of respective colors, and a plurality of ink supplying tubes for coupling the recording heads to ink tanks so that the ink of each color in the ink tanks is supplied to the recording heads, respectively. A specific color ink is ejected in a greater amount per unit time than other colored inks, and an ink supplying tube for the specific color supplies a greater amount than other tubes assigned to other colors.

Another inkjet recording apparatus of the present invention comprises, recording heads mounted to a carriage and ejecting a plurality of colored inks, ink tanks for pooling ink of respective colors; and a plurality of ink supplying tubes for coupling the recording heads to ink tanks so that the ink of each color in the ink tanks is the recording heads, respectively. A viscosity of a specific color of ink is greater than those of other colors of ink, and the ink supplying tube for the specific color supplies equal to or greater amount than the tubes assigned to other colors.

Still another inkjet recording apparatus of the present invention comprises a scanner having a carriage-driving-motor for reciprocating a carriage having recording heads in a scanning direction (X axis direction), and a transfer machine having a transfer motor for transferring a recording paper in a transfer direction (Y axis direction) perpendicular to the scanning direction. Both of the motors are at approximately the same place regarding an ink-ejecting-direction (Z axis direction). Actually, the motors are disposed at a height of the transfer-path of the recording paper, or the motors are disposed on the carriage side with respect to the transfer path.

Still further, another inkjet recording apparatus of the present invention comprises a carriage having recording heads and reciprocating in a scanning direction, ink tanks containing ink to be supplied to the recording heads, and ink supplying tubes routed from the carriage to the ink tanks via travel space for the carriage reciprocating, thereby coupling the carriage to the ink tanks. The inks ejected from the recording heads are attached to a recording paper transferred in a transfer direction perpendicular to a scanning line, thereby performing the recording.

Still another inkjet recording apparatus of the present invention comprises recording heads for ejecting different colored ink independently, a carriage having the recording heads and reciprocating in a scanning direction (X axis direction), a plurality of ink tanks aligned in the scanning direction and containing respective colors of ink to be supplied to the recording heads, ink supplying tubes routed from the carriage to the ink tanks via travel space for the carriage reciprocating, thereby coupling the carriage to the ink tanks, and a coupling section disposed on the ink tank side of the carriage travel space and bundling the ink supplying tubes. Among the plurality of ink tanks, the ink tank containing the ink of the highest viscosity is placed closest to the coupling section. The ink ejected from the recording heads is attached to a recording paper transferred in a transfer direction (Y axis direction) perpendicular to the scanning direction thereby performing the recording.

Still another inkjet recording apparatus of the present invention comprises recording heads for ejecting different colored inks independently, a carriage having the recording heads and reciprocating in a scanning direction (X axis direction), a plurality of ink tanks aligned in the scanning direction and containing respective colors of ink to be supplied to the recording heads, ink supplying tubes routed from the carriage to the ink tanks via travel space for the carriage reciprocating, thereby coupling the carriage to the ink tanks, and a coupling section disposed on the ink tank side of the carriage travel space and bundling the ink supplying tubes. Among the plurality of ink tanks, the tank containing the most consumed ink is placed closest to the coupling section. The ink ejected from the recording heads is attached to a recording paper transferred in a transfer direction (Y axis direction) perpendicular to the scanning direction, thereby performing the recording.

Still another inkjet recording apparatus of the present invention comprises recording heads for ejecting ink, a carriage having recording heads and for reciprocating in a scanning direction (X axis direction), ink tanks containing ink to be supplied to the recording heads, and ink supplying tubes for coupling the carriage to the ink tanks. The ink supplying tubes are coupled to a side of the carriage in a transfer direction (Y axis direction) perpendicular to the scanning direction, i.e., a side section of the carriage in Y direction. The ink supplying tube is also bowed toward a first side in the scanning direction (X axis direction) at a space adjacent to the carriage moving space on the side of Y direction. When the carriage is placed at the end of the first side of the scanning direction, an end position of the bowed section is placed at approximately the same position as the end of the first side in the scanning line, or the end position of the bowed section is placed on a second side from the end of the first side in X axis direction.

The present invention can provide inkjet recording apparatuses in which high-speed recording and downsizing of the apparatus are compatible thanks to the structures discussed above.

DETAILED DESCRIPTION OF THE EXEMPLARY EMBODIMENTS

Exemplary embodiments of the present invention are demonstrated hereinafter with reference to the accompanying drawings.

First Exemplary Embodiment

Figure 1:
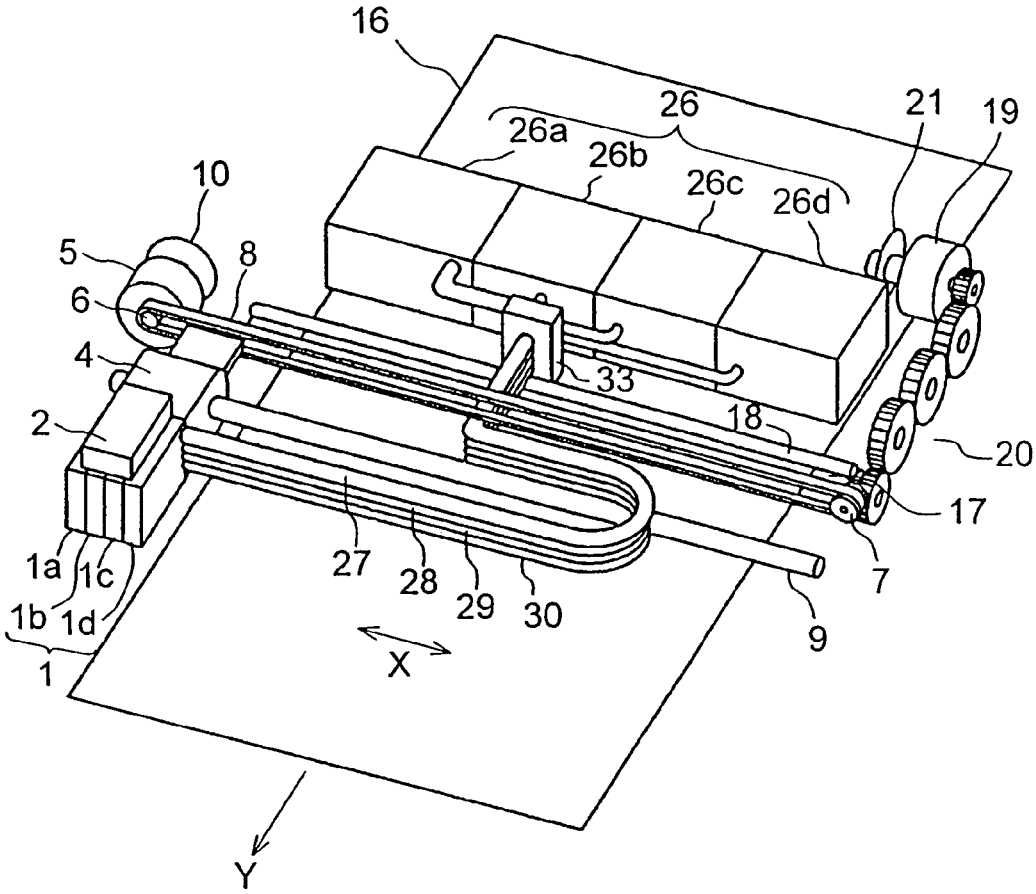
FIG. 1 is a schematic perspective view of an inkjet recording apparatus in accordance with a first exemplary embodiment of the present invention.
Figure 2:
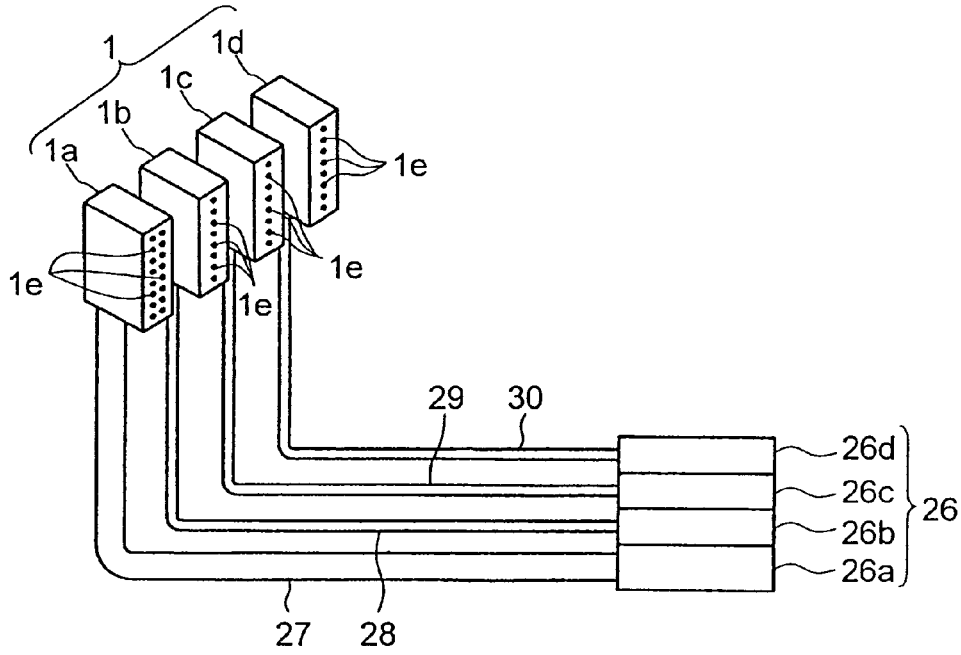
FIG. 2 is a schematic perspective view of ink supplying tubes of the inkjet recording apparatus shown in FIG. 1.

FIG. 1 is a schematic perspective view of an inkjet recording apparatus in accordance with a first exemplary embodiment of the present invention. FIG. 2 is a schematic perspective view of ink supplying tubes of the inkjet recording apparatus shown in FIG. 1.

In the inkjet recording apparatus shown in FIG. 1, recording heads 1 eject inks of a plurality of colors. These heads 1 comprise black-ink-ejecting section 1*a*, yellow-ink-ejecting section 1*b*, magenta-ink-ejecting section 1*c* and cyan-ink-ejecting section 1*d*. These ejecting sections 1*a*, 1*b*, 1*c* and 1*d* are aligned in a moving direction of carriage 4 (X direction shown in FIG. 1.)

On the lower faces of each ejecting section, a plurality of nozzles 1*e*, having the same diameter, are formed as shown in FIG. 2. FIG. 2 illustrates schematically the details of ink-supplying-tubes 27–30, such as a diameter, number of nozzles, length, and the like. The positional relation between the heads 1 and ink tanks 26 and curvatures the of tubes 27–30 are different from those shown in FIG. 1.

Pressuring chambers (not shown) in which the ink is filled are provided at places corresponding to each nozzle 1*e* in respective ejecting sections. Piezoelectric actuators (not shown) are also provided at the same places, and they have a piezoelectric element to which pulse-shaped voltage is applied, thereby reducing a capacity of the pressuring room, which results in deforming the pressuring room. This piezoelectric actuator is activated by a driving circuit 2, so that ink in the pressuring chamber is ejected through the nozzle 1*e* to recording paper 16 located under the nozzles 1*e*. The recording paper 16 is transferred by a transfer motor 19 in Y direction, shown in FIG. 1.

A number of nozzles 1*e* assigned to black ink (a specified color) ejecting section 1*a* is greater than those to other ejecting sections 1*b*, 1*c* and 1*d*. Therefore, the amount of black ink per unit time ejected from nozzles 1*e* of ejecting section 1*a* is greater than those of inks of other colors ejected from nozzles 1*e* of other ejecting sections.

The head 1 is rigidly mounted to the carriage 4 which is movable relative with respect to the recording paper 16. The carriage 4 forms right angles with a transfer direction (Y direction) of the paper 16 and is disposed on a first side of a direction (X direction shown in FIG. 1) along the paper 16. The carriage 4 is mounted to a guide shaft 9 such that the shaft 9 extends through the carriage 4, and is fixed at a span under a carriage driving belt 8. The belt 8 is wound on a driver pulley 6 driven by carriage driving motor 5 disposed on a first side and a follower pulley 7 disposed on a second side. The shaft 9 is supported by the apparatus itself (not shown) and extends along the X axis. This structure allows the pulley 6 to rotate, thereby driving the belt 8, and then the carriage 4, i.e., the recording head 1 reciprocates in X direction being guided by the shaft 9. The motor 5 includes a rotary detector 10 which is combined with a detecting sensor (not shown) to detect a rotational volume of the motor 5, i.e., a position of the head 1 in the X direction.

The paper 16 is pinched between a transfer roller 17 and a pressure roller 18. Both of the rollers extend in the X direction, and the roller 18 is urged to an upper surface of the roller 17 by a given pressure. The transfer motor 19 is disposed at a rear side of the transfer direction of the paper 16 with respect to the roller 18. The rotation of the motor 19 is transmitted to the roller 17 via a gear row 20. Rotation of the roller 17 transfers the paper 16 in the Y direction. The motor 19 includes a rotary detector 21 which is combined with a detecting sensor (not shown) to detect a rotational volume of the motor 19, i.e., the transferred volume of the paper 16 in the Y direction.

Between the roller 18 and the motor 19, there are ink tanks 26 containing ink of respective colors fixed to the apparatus itself (not shown). In other words, the ink tanks 26 are not disposed on the carriage 4 (recording head 1), but disposed somewhere to the apparatus itself other than the carriage 4. The tank 26 comprise four individual tanks the, including a black ink tank 26*a*, a yellow ink tank 26*b*, a magenta ink tank 26*c*, and a cyan ink tank 26*d*. These four individual tanks are aligned in the X direction.

The four ink-supplying-tubes 27–30 couple the head 1 to the tanks 26 and the tubes supply the ink of respective colors in the individual tanks to the heads 1. The tube 27 couples the black ink ejecting section 1*a* of the head 1 to the black ink tank 26*a*, and the tube 28 couples the yellow ink ejecting section 1*b* to the yellow ink tank 26*b*. The tube 29 couples the magenta ink ejecting section 1*c* to the magenta ink tank 26*c*, and the tube 30 couples the cyan ink ejecting section 1*d* to the cyan ink tank 26*d*. A coupling member 33 is disposed near the front side of the tanks 26 with respect to the transfer direction of the paper 16. These four tubes 27–30 are bundled in the vertical direction by the coupling member 33. The tubes extend in the Y direction, then extend toward the second side in the X direction, i.e., toward the pulley 7 side, then curve and extend toward the first side in the X direction, i.e., toward the pulley 6 side, and finally arrive at the head 1. Thus, when the head 1 moves in the X direction together with the carriage 4, curved sections of the tubes 27–30 move so that the tubes 27–30 do not prevent the head 1 from moving. The tubes 27–30 between the coupling member 33 and the head 1 are vertically adjacent, and in approximate contact with each other. However, they are not bonded (they can be bonded).

The black ink supplying tube 27 supplies a greater amount of ink than the other tubes 28–30. To be more specific, the tubes 28–30 for yellow, magenta and cyan inks have the same diameter, while the tube 27 for black ink has a larger diameter along the entire length.

This structure allows the black ink to flow in a greater amount than the other colored inks, and allows the fluid resistance in the tube 27 to lower. Thus, the supplying amount of black ink per unit time can be greater than other colored inks. As a result, black ink can be supplied to the black ink ejecting section 1*a* without fail although a number of nozzles 1*e* as the ejecting section 1*a* is greater than those of the other ejecting sections 1*b*, 1*c* and 1*d*, as well as, the ejected amount of black ink per unit time is greater than other inks. On the other hand, since only tube 27 among others is enlarged in its diameter, the apparatus is restrained from becoming larger. As such, the printing speed with black ink can be faster, while a size of the apparatus is restrained from becoming larger.

In this first embodiment, the diameter of the tube 27 is greater than the other tubes 28–30 along the entire length. However, when only a part of the tube has a greater diameter than the other tubes 28–30, the fluid resistance the black ink bears decreases accordingly. Thus, the supply amount of black ink per unit time can be greater than the other colored inks.

Second Exemplary Embodiment

Figure 3:
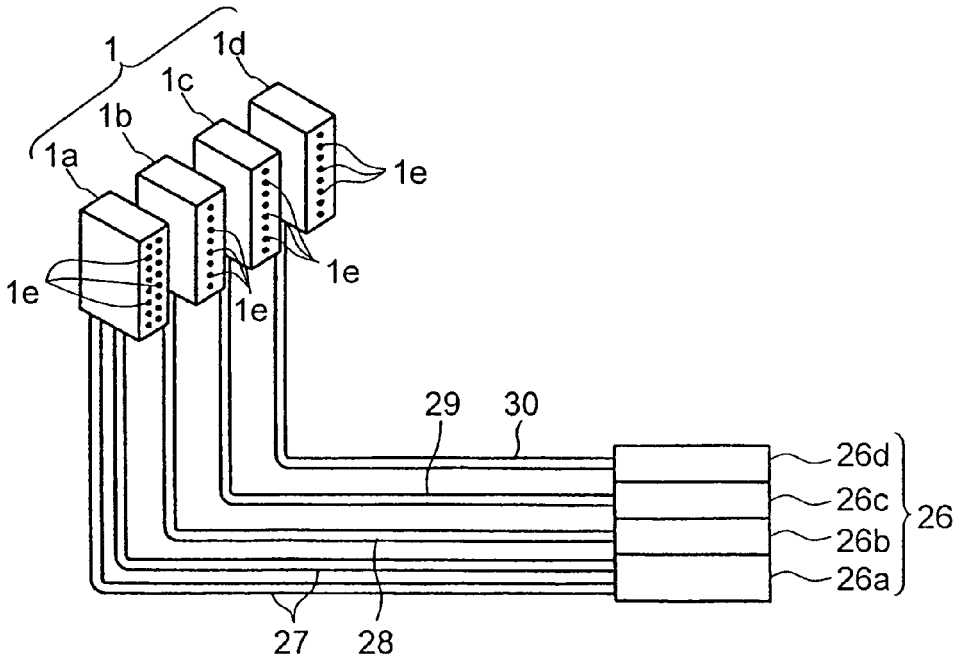
FIG. 3 is a schematic perspective view of ink supplying tubes of an inkjet recording apparatus in accordance with a second exemplary embodiment of the present invention.

FIG. 3 is a schematic perspective view of ink supplying tubes of an inkjet recording apparatus in accordance with the second exemplary embodiment of the present invention.

In FIG. 3, the same elements shown in FIG. 2 bear the same reference marks, and descriptions thereof are, thus, omitted. In the second embodiment, the black ink supplying tube 27 shown in FIG. 2 of the first embodiment is modified. To be more specific, in the second embodiment, two pieces of the tube 27 are provided, i.e. a greater number of black ink supplying tubes than other tubes for other colored inks are available. The two tubes are independently formed, and their diameters are the same as those of the other tubes 28–30.

Therefore, in this second embodiment, the flowing amount of the black ink is greater than those of other colored inks, and the supply amount of the black ink per unit time can be greater than those of other colored inks. As a result, the same advantage as the first embodiment is obtainable.

Figure 4:
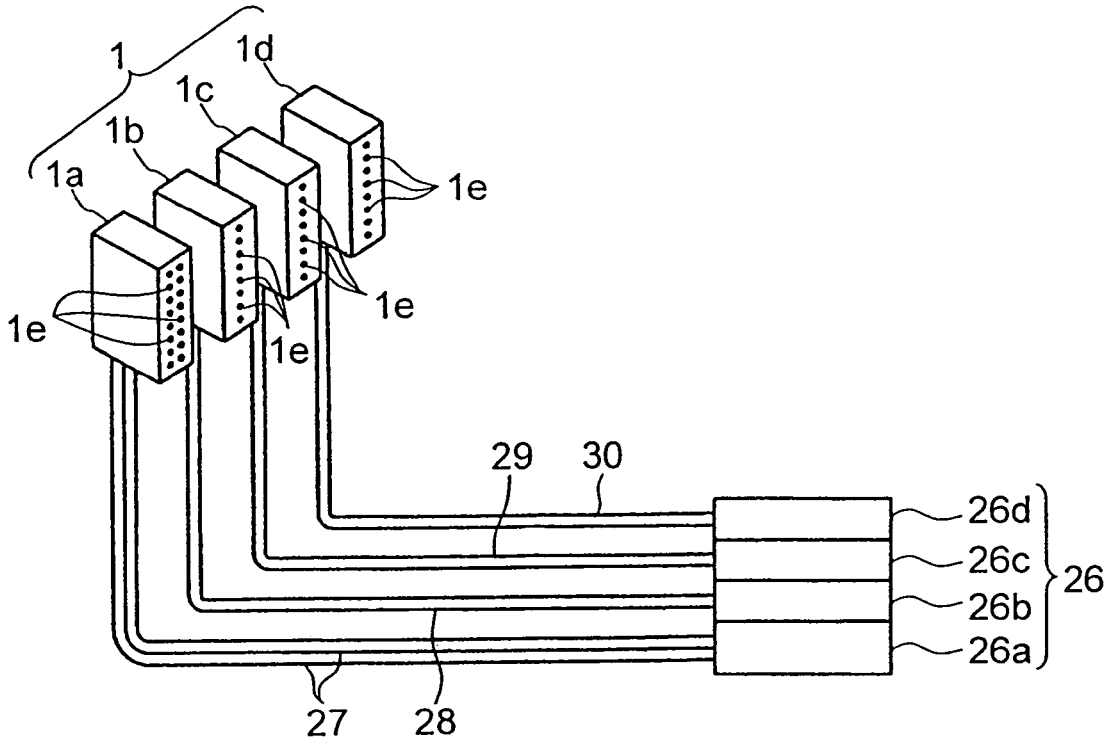
FIG. 4 is a schematic perspective view of a modification of the ink supplying tubes in the same apparatus shown in FIG. 3.

FIG. 4 is a schematic perspective view of a modification of the ink supplying tube in accordance with the second embodiment of the present invention. In the second embodiment, the two tubes 27 are independently formed; however, in the modification shown in FIG. 4, two tubes 27 are integrated into one unit. Three or more of the tubes 27 can be provided. In this case, all of the tubes can be integrated into one unit, or at least two of them can be integrated into one unit.

Third Exemplary Embodiment

Figure 5:
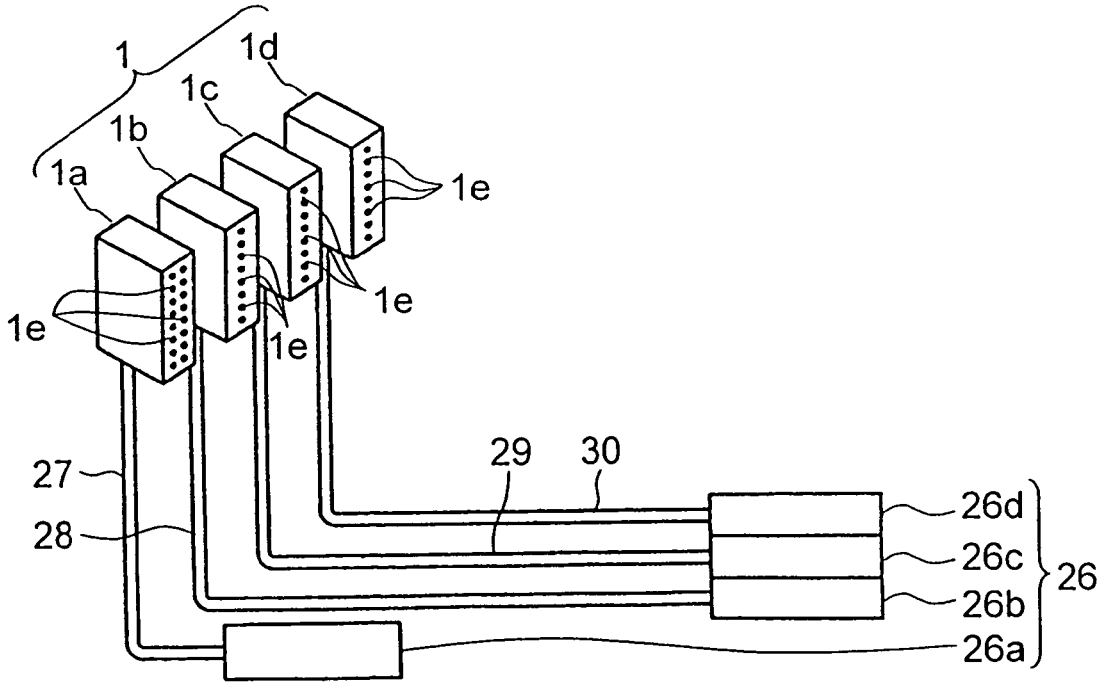
FIG. 5 is a schematic perspective view of ink supplying tubes of an inkjet recording apparatus in accordance with a third exemplary embodiment.

FIG. 5 is a schematic perspective view of ink supplying tubes of an inkjet recording apparatus in accordance with the third exemplary embodiment.

In FIG. 5, the same elements shown in FIG. 2 bear the same reference marks, and descriptions thereof are thus omitted. In this third embodiment, the respective ink-supplying-tubes 27 30 have the same diameter and the same number of tubes are assigned to respective colors. However, the tube 27 for black ink has a shorter length than the other tubes 28–30.

To be more specific, the black ink tank 26*a* is disposed away from the other tanks 26*b*, 26*c* and 26*d*. The black ink supplying tube 27 is routed in a different way from other tubes, such as not via the coupling member 33, and arrives at the black ink ejecting section 1*a* of the head 1.

The shorter length of the tube 27 allows the black ink to bear a large fluid resistance within a shorter length than other colored inks which travel in the longer length of the tubes 28–30. Therefore, the supply amount of black ink per unit time can be greater than other colored inks. As a result, the same advantage as the first and second embodiments can be obtained.

In the first through the third embodiments, a number of the nozzles 1*e* of black ink ejecting section 1*a* is greater than those of the other ejecting sections 1*b*, 1*c* and 1*d*. However, if the number of nozzles is the same as the others, a diameter of the nozzle 1*e* can be greater than those of the others, or a waveform of a voltage applied to the piezoelectric element corresponding to the nozzle 1*e* can be changed from those of other nozzles. Thus, a supply amount of the black ink per unit time can be greater than those of other colored inks.

A supply amount of any specific color per unit time can be increased, and it is not limited to the black color. The specific color is not always one color, and two or more colors can be assigned to the specific colors. A supply amount from any specific colored ink supplying tube per unit time can be greater than those of other supplying tubes.

Fourth Exemplary Embodiment

Figure 6:
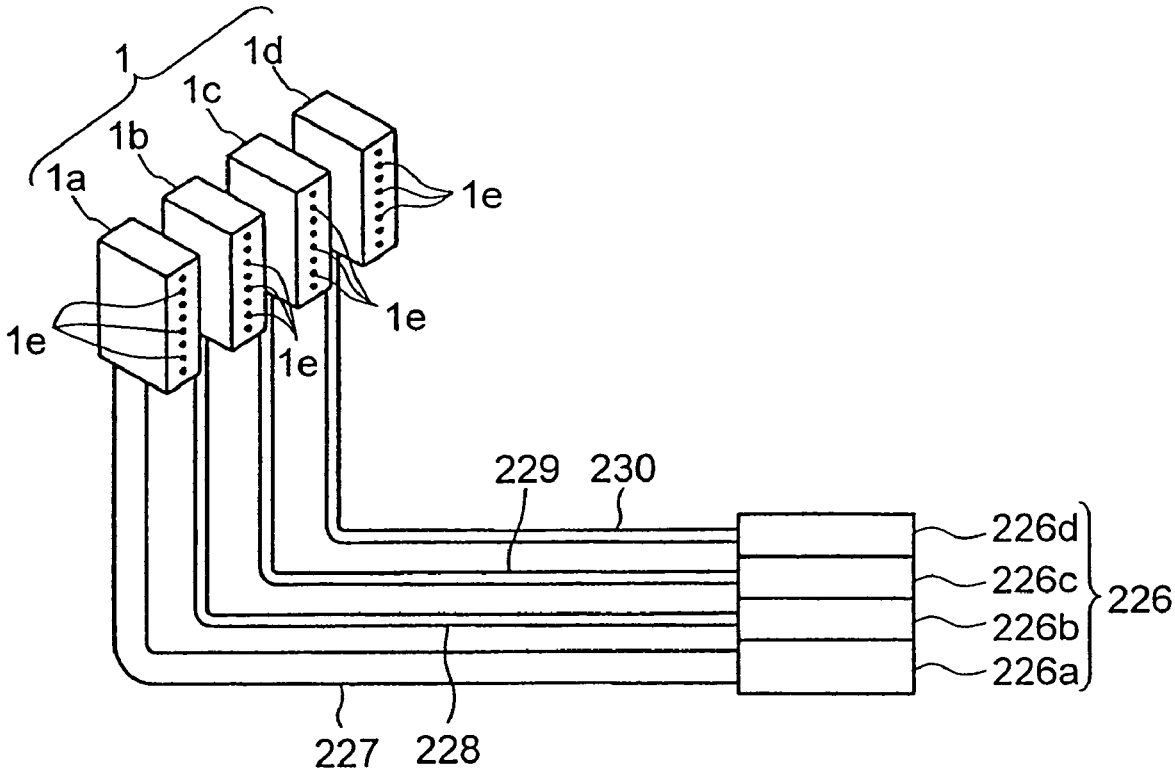
FIG. 6 is a schematic perspective view of an ink supplying tubes of an inkjet recording apparatus in accordance with a fourth exemplary embodiment.

FIG. 6 is a schematic perspective view of an ink supplying tubes of an inkjet recording apparatus in accordance with the fourth exemplary embodiment.

In FIG. 6, the same elements shown in FIG. 2 bear the same reference marks, and descriptions thereof are, thus, omitted. In this fourth embodiment, viscosity of black ink is greater than those of other colored inks. To be more specific, the colored inks other than, the black ink employ dye type inks, while the black ink employs a pigment type ink of which the viscosity is greater than that of the dye type.

A supply amount from black ink supplying tube 227 per unit time is not less than those of other tubes 228–230. In other words, the diameter of the tube 227 is larger than those of the other tubes 228–230 along the entire length. Also, only a part of the tube 227 can have a greater diameter than others.

This structure allows the supply amount of the black ink to be not less than those of the other colored inks, although the viscosity of the black ink is greater than those of the other colored inks. As a result, the black ink can be positively supplied to its ejecting section 1*a* without lowering printing speed, so that clear and crisp printing in black ink can be achieved.

In this fourth embodiment, the diameter of the tube 227 is greater than those of tubes 228–230. However, as demonstrated in the second embodiment, the number of the tubes 227 can be greater than numbers of the other tubes 228–230, or as demonstrated in the third embodiment, the length of the tube 227 can be shorter than those of the other tubes 228–230. In this fourth embodiment, a pigment type ink is used as the black ink; however, it is not limited to the pigment type, but the viscosity of the black ink can be greater than the other inks in any way. A specific color having a greater viscosity is not limited to the black ink, and other inks can have a greater viscosity. The specific color is not always limited to one color, and two or more colors can be available to the specific color, and the supply amount from the specific colored ink supplying tube can be not less than those from other colored ink supplying tubes.

As discussed above, in the inkjet recording apparatus in accordance with the first through the fourth embodiment, an ejected amount of a specific colored ink from the nozzles per unit time is set greater than those of other colored inks. The ink-supplying-tube for the specific colored ink is designed to supply a greater amount of ink per unit time than other ink-supplying-tubes. In another inkjet recording apparatus, a viscosity of a specific colored ink is set greater than those of other colored inks, and the ink-supplying-tube for the specific colored ink is designed to supply a greater amount of ink per unit time than other ink-supplying-tubes. According to the first through the fourth embodiments, the apparatus is restrained from being greater size, while a specific colored ink is positively supplied to a recording head. As a result, printing speed with the specific colored ink can be increased, or a clear printing in the specific colored ink is obtainable.

Fifth Exemplary Embodiment

Figure 7:
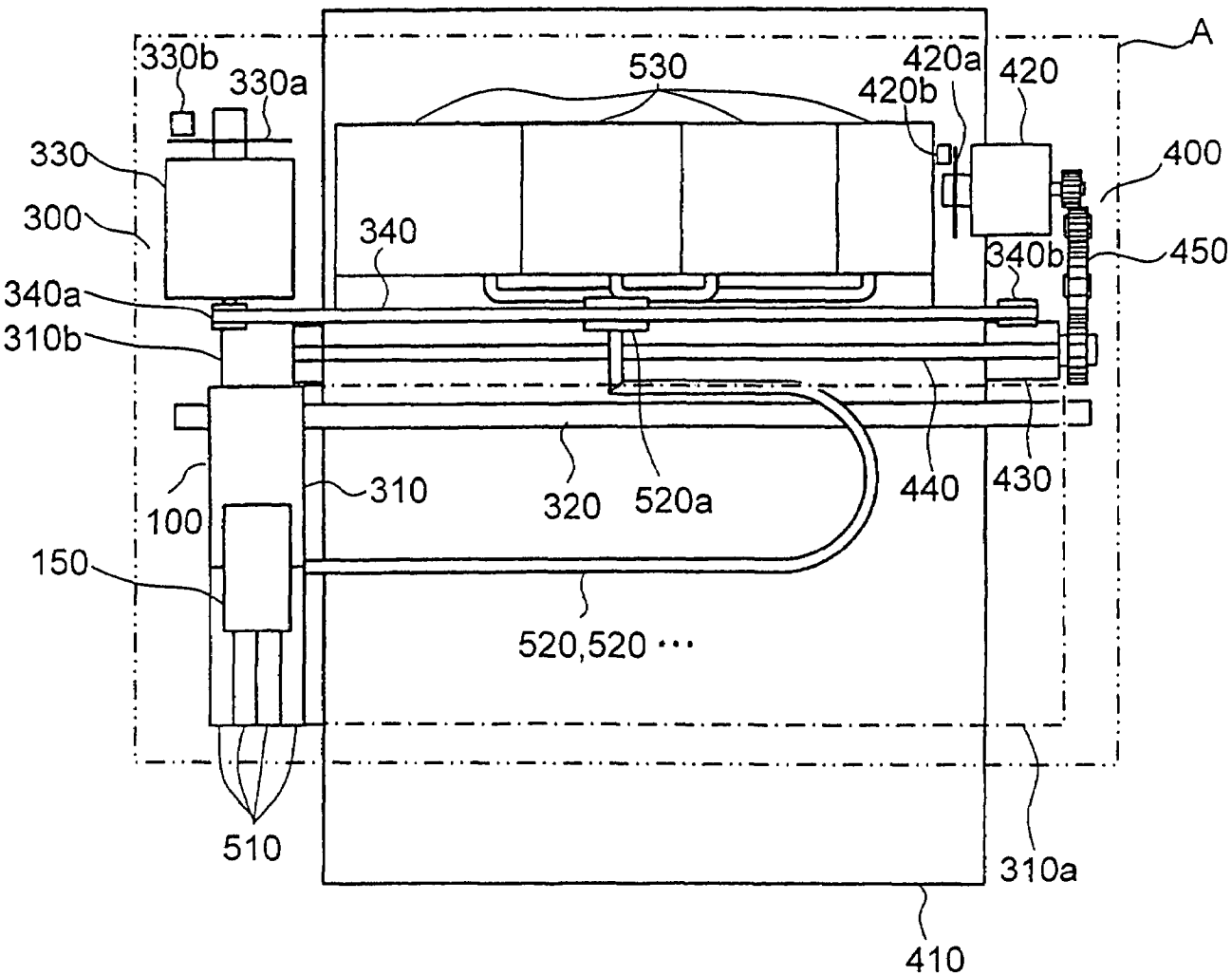
FIG. 7 is a plan view of an inkjet recording apparatus in accordance with a fifth exemplary embodiment.
Figure 8:
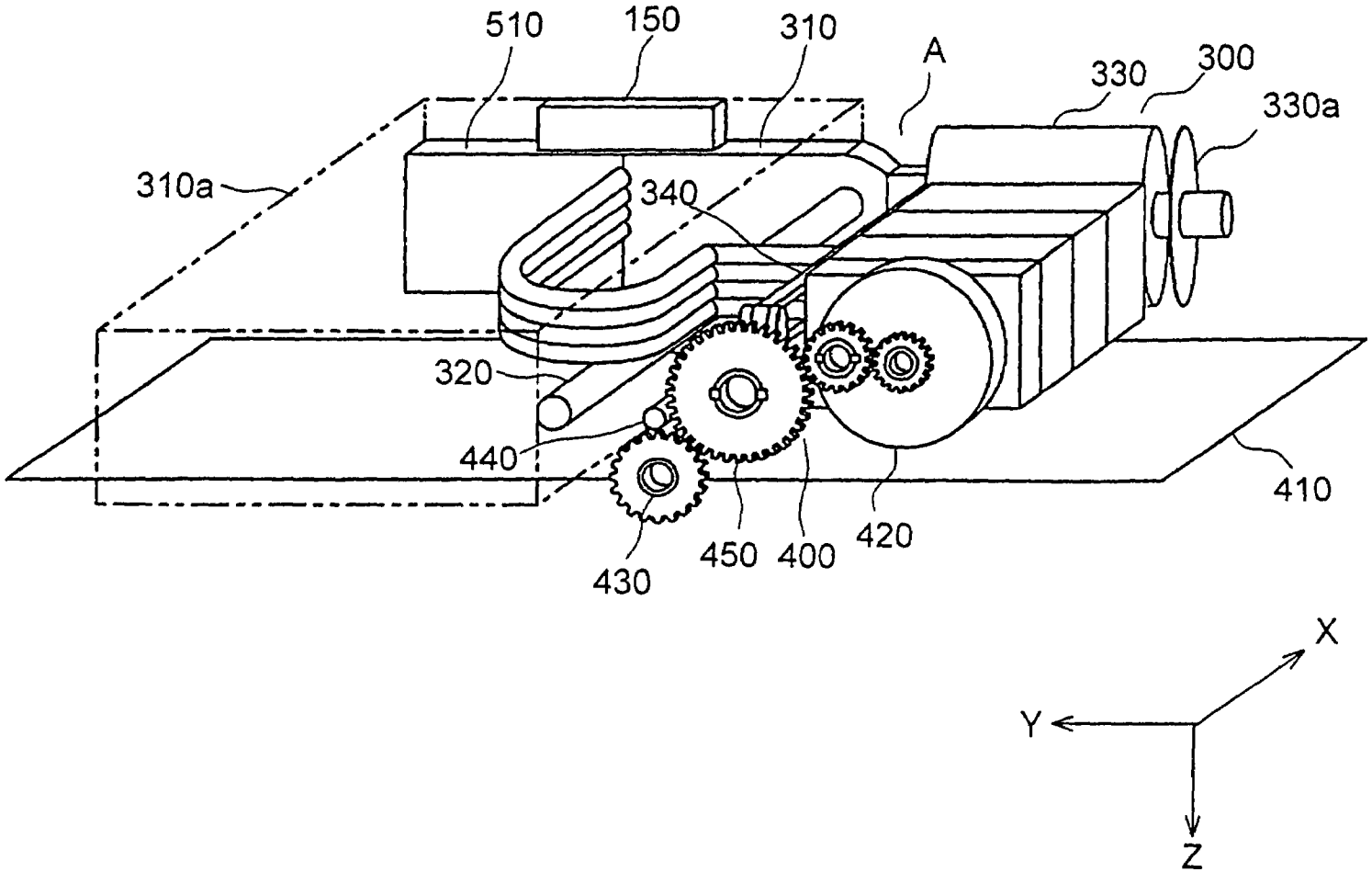
FIG. 8 is a perspective view of the inkjet recording apparatus in accordance with the fifth exemplary embodiment.
Figure 9:
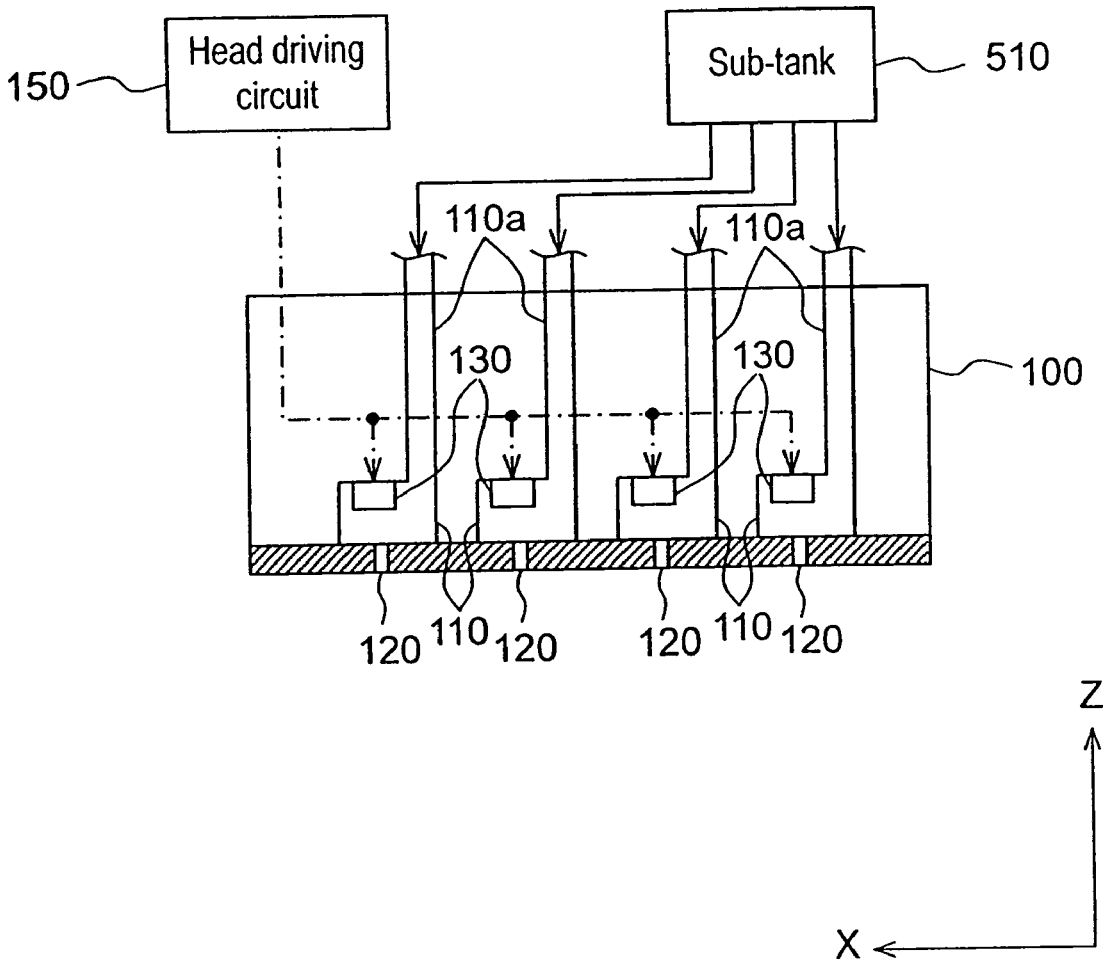
FIG. 9 is an enlarged view of recording heads of the apparatus shown in FIG. 8.

FIG. 7 is a plan view of an inkjet recording apparatus in accordance with the fifth exemplary embodiment. FIG. 8 is a perspective view of the same apparatus. FIG. 9 is an enlarged view of recording heads of the apparatus shown in FIG. 8.

As shown in FIGS. 7 and 8, inkjet recording apparatus A ejects the inks of yellow, magenta, cyan and black, respectively, from recording heads 100 to recording paper 410, thereby performing color recording on the paper 410.

Heads 100 are provided to a carriage 310, and a scanner 300 reciprocates the carriage 310 in a scanning direction (X direction shown in FIG. 8). A transfer machine 400 transfers recording paper 410 in a transfer direction (Y direction shown in FIG. 8) perpendicular to the scanning direction.

A carriage moving space 310*a* the space where the carriage 310 reciprocates in the scanning direction extends in the scanning direction. The carriage 310 reciprocates within the space 310*a* in the scanning direction, so that the heads 100 also reciprocate in the scanning direction. The scanner 300 comprises a carriage shaft 320 for guiding the carriage 310, a carriage driving motor 330 as a driving source for reciprocating the carriage 310, and a carriage driving belt 340 for transferring the carriage 310.

The shaft 320 is disposed extending in the scanning direction. The carriage 310 is mounted to the shaft 320 so that the carriage 310 moves along the shaft 320 being guided by the shaft 320. The belt 340 winds on a driver pulley 340*a* and a follower pulley 340*b* spaced from each other in the scanning direction.

The motor 330 is adjacent to the space 310*a* with respect to the transfer direction and disposed on a first side of the scanning direction. As shown in FIG. 8, the motor 330 is disposed on the side of the carriage 310 with respect to the transfer path, i.e., an upstream side in the ink ejecting direction with respect to the transfer path (Z direction shown in FIG. 8). The pulley 340*a* is mounted to a rotary shaft of the motor 330, and spinning of the motor 330 causes the pulley 340*a* to spin. The spin of the pulley 340*a* is transferred to the pulley 340*b* via the belt 340.

On the carriage 310, an engaging section 310*b* for engaging with the belt 340 is formed. When the belt 340 is driven, the engaging section 310*b* is transferred by the belt 340, therefore, the rotary shaft of the motor 330 is normally driven or reversedly driven, so that the carriage 310 reciprocates in the scanning direction. The transfer machine 400 comprises a transfer motor 420 as a driving source for transferring the medium 410 a transfer rotor 430 and a pressing rotor 440 both for pinching and transferring the paper 410. The motor 420 is adjacent to the space 310*a* in the transfer direction and disposed on a second side of the scanning direction. In other words, the motor 420 is disposed away from the motor 330 in the scanning direction. Therefore, the motor 330 and the motor 420 are disposed at respective corners of apparatus A. (Refer to two-dot chain lines in FIG. 7.)

The motor 420 is disposed on upstream side in the ink ejecting direction (Z direction shown in FIG. 8) with respect to the transfer path. In other words, as shown in FIG. 8, the motor 420 and the motor 330 are disposed at approximately the same place on the Z axis. The roller 430 is disposed extending in the scanning direction, and has a gear on its tip. The gear engages with a plurality of gears 450 in series and finally engages with the rotary shaft of the motor 420. This structure allows the roller 430 to rotate around the rotary shaft of the motor 420 when the rotary shaft of the motor 420 spins. The roller 440 faces the roller 430, and urges the paper 410 against the roller 430. Thus, when the motor 420 spins, the paper 410 pinched between the roller 430 and the roller 440 is transferred in the transfer direction.

On each shaft of the motor 330 and the motor 420, rotary detectors 330*a* and 420*a* are mounted. In order to detect a rotating angle of the rotary detectors 330*a* and 420*a*, rotating angle detecting sensors 330*b* and 420*b* are disposed and face the rotary detectors. The motor 330 and the motor 420 are controlled based on rotating angles of respective rotary shafts thereof. The rotating angles are detected by the sensors 330*b* and 420*b*. Controlling of both the motors also controls the position of the carriage 310 and the position of the paper 410. These two motors are rather high power motors and have rather large shapes.

The recording head 100 disposed to the carriage 310 is now described. FIG. 9 is an enlarged view of the recording head of the apparatus. The head 100 comprises a plurality of pressuring chambers 110 in which colored inks such as yellow, magenta, cyan and black are filled, a plurality of nozzle-holes 120 disposed on walls defining the respective chambers 110, and for ejecting the inks from the chambers 110, and actuators 130 actuating and deforming so that capacities of the respective chambers 110 decrease.

Ink flow-paths 110*a*, through which the ink is supplied, communicate with the chambers 110. These paths 110*a* are coupled to a sub-tank 510 mounted to the carriage 310.

The actuators 130 are disposed on the walls of the chambers 110 facing the walls on which the nozzle-holes 120 are formed. The actuators 130 are formed by piezoelectric film pinched by a pair of electrodes. A pulse is applied over the pair of electrodes, and a rise of pulse voltage makes the actuator 130 bow downward (protrudes inside of the chamber 110) due to a bimetal effect. This deflection ejects the ink in the chamber 110 through the nozzle-hole 120 toward the paper 410. On the other hand, a fall of pulse voltage restores the actuator 130, then ink is filled in the chamber 110 through the flow path 110*a*. The voltage applied to the actuator 130 is controlled by a head driving circuit 150 disposed on the carriage 310. The driving circuit 150 controls the deforming of the actuator 130, so that ejection of the ink is controlled.

Sub-tanks 510 are provided for respective colored inks. As shown in FIGS. 7 and 8, the sub-tanks 510 are mounted to the carriage 310 and reciprocate together with the carriage 310 in the space 310*a* in the scanning direction. Ink supplying tubes 520 (four tubes in total) of respective colors are coupled to each of the sub-tanks 510. These tubes 520 are aligned in an ejecting direction (Z axis direction) and integrated into one unit. The tubes 520 run through the space 310*a* and arrive at a coupling member 520*a* disposed at approximately the center in the scanning direction (X axis direction.) At the coupling member 520*a*, the tubes 520 are separated into respective colors, and coupled to respective main tanks 530 containing respective colored inks. The respective main tanks 530 are divided into four respective colors and aligned in the scanning direction (X axis direction), and placed between the motor 330 and the motor 420. In the Z axis direction, the tanks 530 are disposed on the same side as the carriage 310 is disposed with respect to the transfer path.

Regarding the four supplying tubes 520 extending between the coupling member 520*a* and the carriage 310, power lines for the driving circuit 150 and other wires for signals (not shown) are integrally routed in parallel with the tubes 520.

An operation and advantages of the fifth embodiment are demonstrated hereinafter. As shown in FIG. 8, the carriage driving motor 330 and the transfer motor 420 do not interfere with each other on the transfer path of the paper 410, because both of the motors are disposed on the same side that the carriage 310 is disposed with respect to the transfer path in the ejecting direction (Z axis direction) viewed from the scanning direction (X axis direction).

Further, since both of the motors are disposed at approximately the same place regarding the Z axis direction, a space for one motor can accommodate the two motors in the Z axis direction. Therefore, the apparatus A can be downsized substantially in the Z axis direction.

As discussed above, since both of the motors are disposed on the same side that the carriage 310 is disposed with respect to the transfer path, both of the motors can be placed in a space adjacent to the carriage-moving-space 310*a*. Therefore, no additional space is required only for accommodating both of the motors. As a result, even if both of the motors are rather large in size, the apparatus A can be downsized.

Still further, both of the motors generate heat due to operation; however since they are disposed away from each other in the scanning direction (X axis direction), the apparatus A does not encounter a local high temperature. Thus, troubles due to heat can be avoided.

Both of the motors are away from each other in the scanning direction, thus, the main tanks 530 can be disposed in a space extending between both of the motors. Therefore, no additional space is required only for accommodating the tanks 530. As a result, the apparatus A can be downsized in both the ejecting direction and transfer direction.

The space between both of the motors is rather large, thus, the capacities of the tanks 530 can be increased. This is convenient for a certain type of tanks 530, which ejects a greater amount of ink per unit time at higher recording speed. Further, the tanks 530 are disposed at a place adjacent to the carriage moving space 310*a* in the transfer direction. Thus, the length of the ink-supplying-tubes 520 becomes short, and flow path resistance in the tubes 520 against the ink becomes less, so that the ink can be supplied in a stable manner to the recording head 100. As a result, stable recording is achievable, and a high-speed of the apparatus A is obtainable.

The fifth embodiment proves that even if the carriage driving motor 330 and the transfer motor 420 are large in size, the apparatus A can be downsized in both the ejecting direction (Z axis direction) and the transfer direction (Y axis direction). Thus, higher recording speed and downsizing of the apparatus are compatible.

Sixth Exemplary Embodiment

Figure 10:
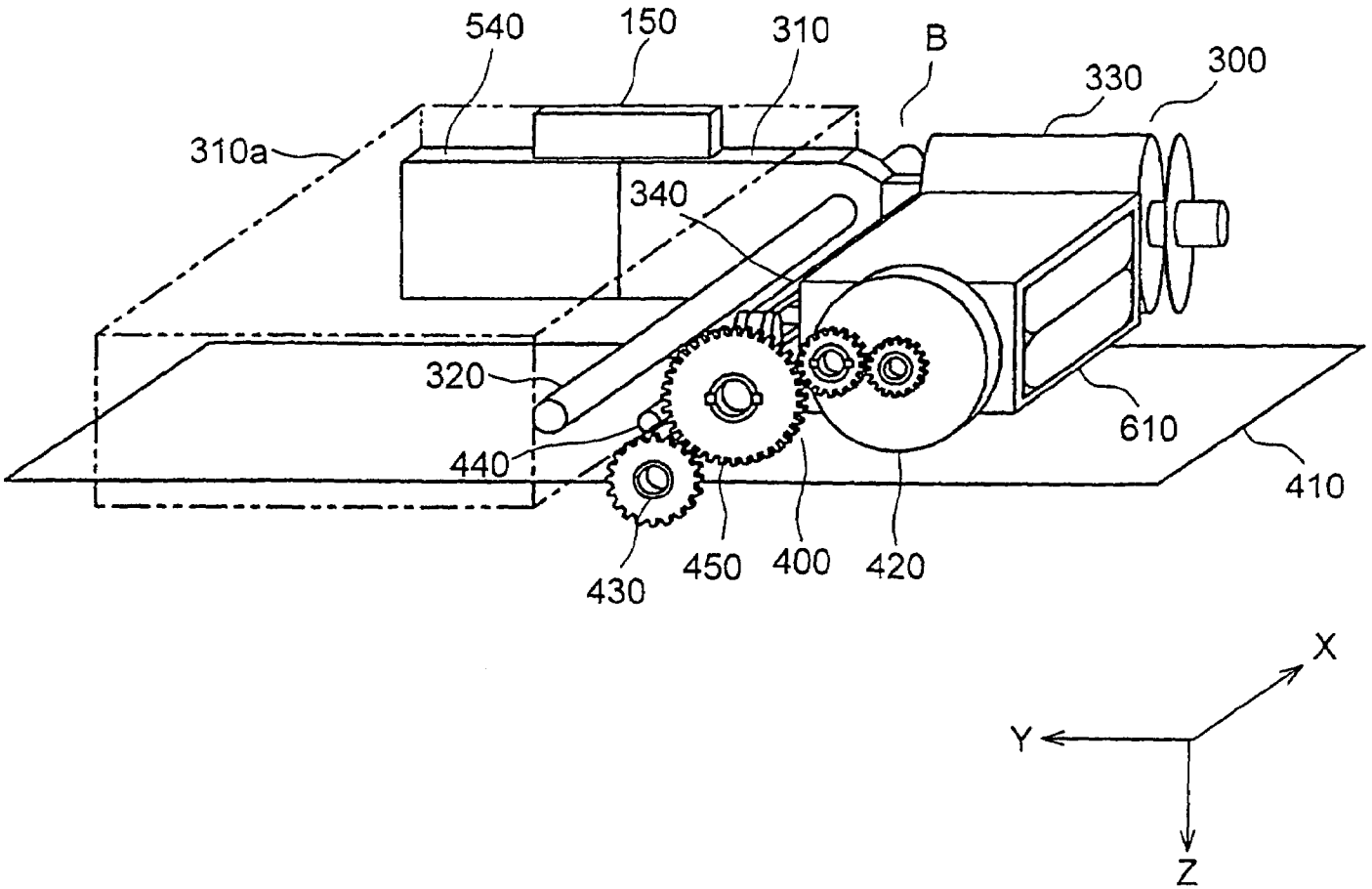
FIG. 10 is a perspective view of an inkjet recording apparatus in accordance with a sixth exemplary embodiment.

FIG. 10 is a perspective view of an inkjet recording apparatus in accordance with the sixth exemplary embodiment. The sixth embodiment differs from the fifth embodiment in the following point.

In apparatus A shown in FIG. 8 used in the fifth embodiment, the main tanks are placed between the carriage driving motor and the transfer motor. However, in ink-jet-recording apparatus B used in the sixth embodiment, shown in FIG. 10, a battery pack 610, as a power source, is placed between the carriage driving motor 330 and the transfer motor 420. In other words, the main tanks are omitted in this sixth embodiment, and the apparatus B has only the ink tanks 540 mounted to the carriage 310. The battery pack 610, instead, is placed between both the motors and on the same side that the carriage 310 is disposed. The battery pack 610 powers the scanner 300, the transfer machine 400 and the like.

Other structures of the apparatus B remain the same as that used in the fifth embodiment, and the same elements bear the same reference marks and the descriptions thereof are thus omitted here. The apparatus B in accordance with the sixth embodiment is good as a portable ink-jet-recording apparatus. The space between both of the motors is used for accommodating the battery pack 610, thus a high-speed ink-jet-recording apparatus of a compact size is obtainable.

Seventh Exemplary Embodiment

Figure 11:
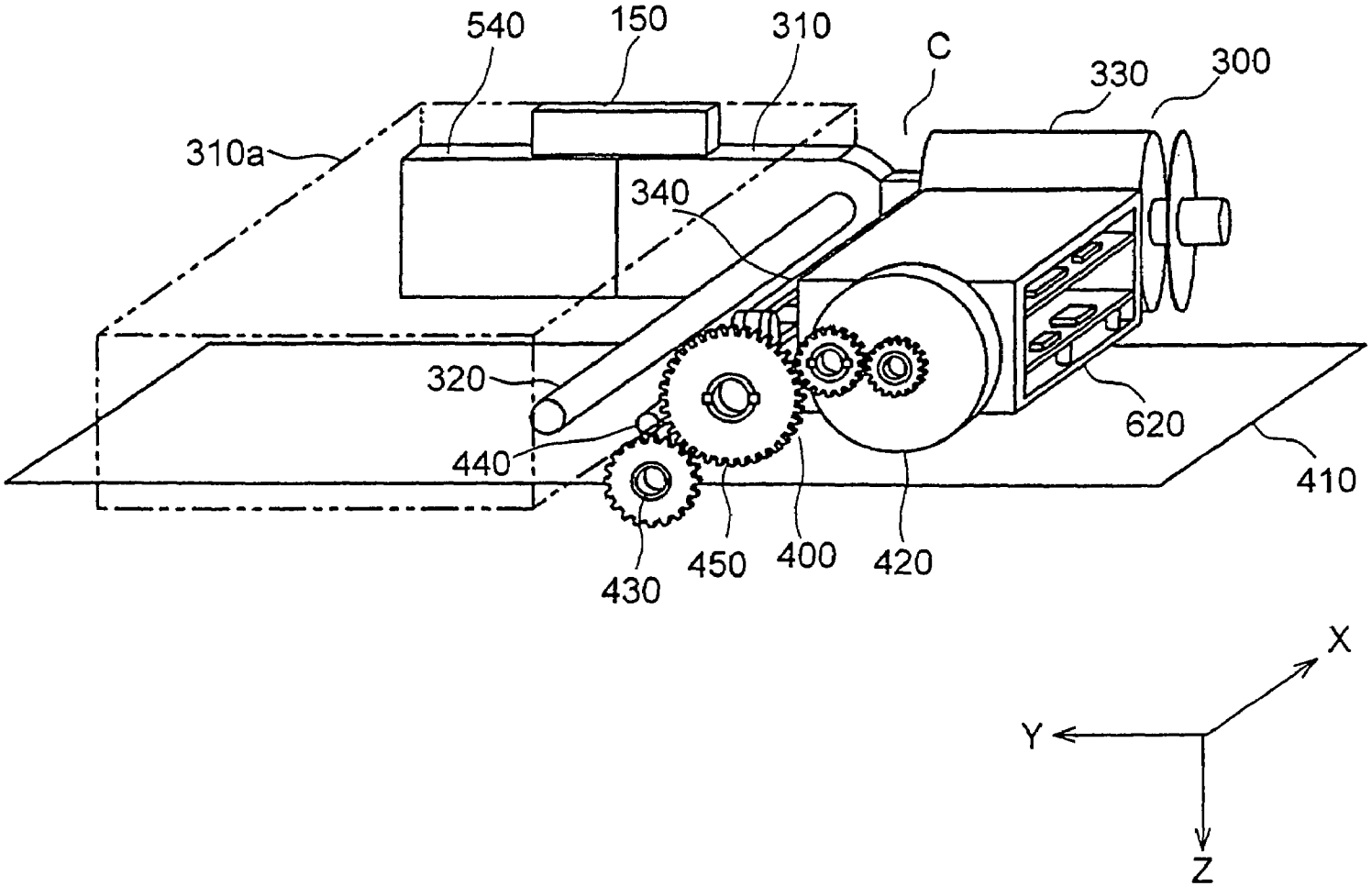
FIG. 11 is a perspective view of an inkjet recording apparatus in accordance with a seventh exemplary embodiment.

FIG. 11 is a perspective view of an inkjet recording apparatus in accordance with the seventh exemplary embodiment. The seventh embodiment differs from the fifth embodiment in the following point.

In the apparatus A, shown in FIG. 8, used in the fifth embodiment, the main tanks are placed between the carriage driving motor and the transfer motor. However, in ink-jet-recording apparatus C used in the seventh embodiment, shown in FIG. 11, an electric circuit 620, as a controller, is placed between carriage driving motor 330 and the transfer motor 420.

The apparatus C used in the seventh embodiment omits the main tanks and has only the ink tanks 540 mounted to the carriage 310, and the circuit 620 controlling scanner 300, the transfer machine 400 and the like is placed between both of the motors. The circuit 620 is placed on the same side that the carriage 310 is placed with respect to the transfer path.

The other structure of the apparatus C remains the same as that used in the fifth embodiment, and the same elements bear the same reference marks and the descriptions thereof are, thus, omitted here. The space between both of the motors is used for accommodating the circuit 620, thus a high-speed ink-jet-recording apparatus with a compact size is obtainable.

Eighth Exemplary Embodiment

Figure 12:
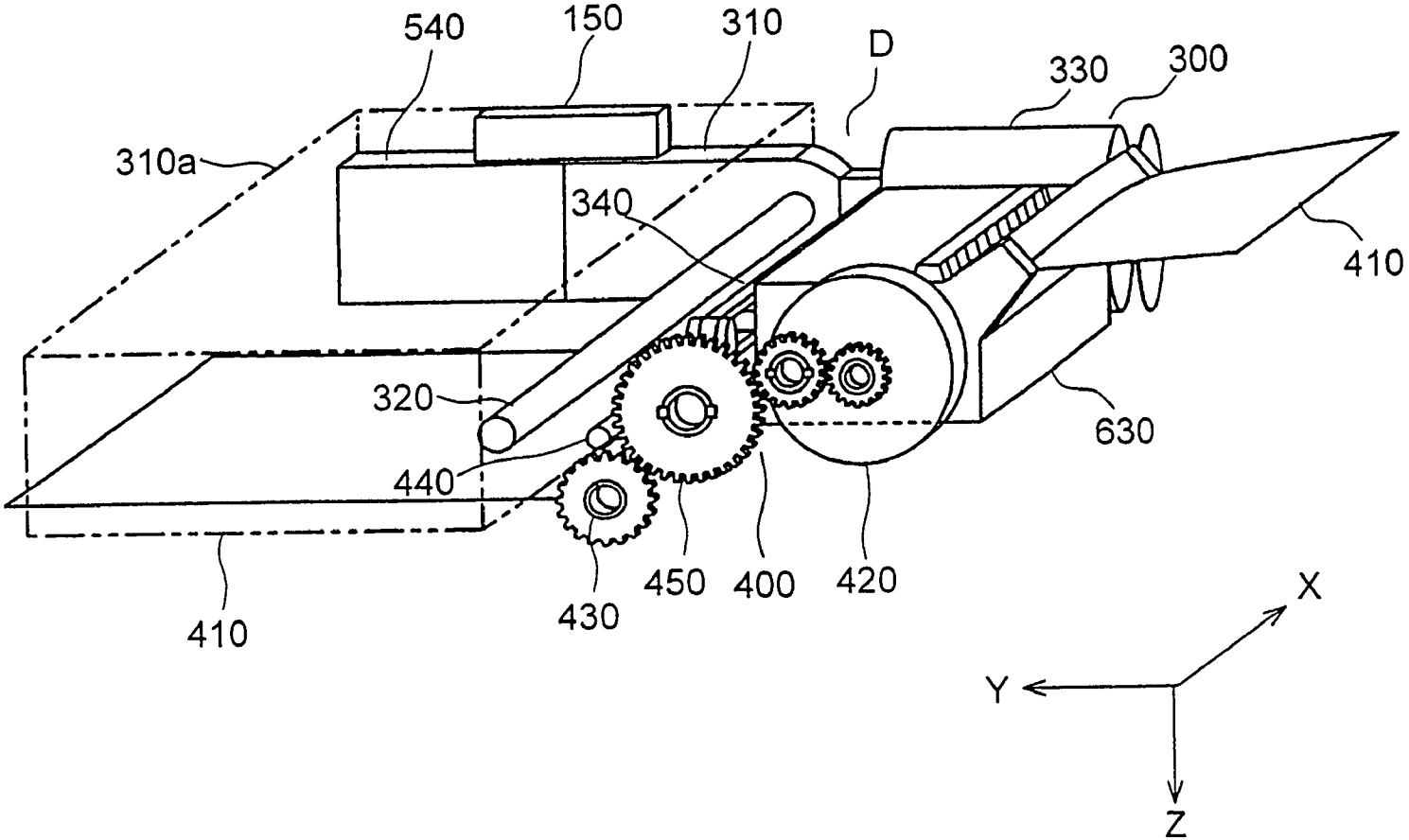
FIG. 12 is a perspective view of an inkjet recording apparatus in accordance with an eighth exemplary embodiment.

FIG. 12 is a perspective view of an inkjet recording apparatus in accordance with the eighth exemplary embodiment. The eight embodiment differs from the fifth embodiment in the following point.

In the apparatus A, shown in FIG. 8, used in the fifth embodiment, the main tanks are placed between the carriage driving motor and the transfer motor. However, in ink-jet-recording apparatus D used in the eighth embodiment shown in FIG. 12, a feeder 630 for feeding the paper 410 to the transfer machine 400 is placed between the carriage driving motor 330 and the transfer motor 420.

The apparatus D used in the eighth embodiment omits the main tanks and has only the ink tanks 540 mounted to the carriage 310, and the feeder 630 is instead placed between both of the motors. The feeder 630 is placed on the same side that the carriage 310 is placed with respect to the transfer path. The feeder 630 holds a plurality of the paper 410 and supplies the paper 410 one by one to the transfer machine 400.

Other structures of the apparatus D remain the same as that used in the fifth embodiment, and the same elements bear the same reference marks and the descriptions thereof are, thus, omitted here. The space between both of the motors is used for accommodating the feeder 630, thus a high-speed ink-jet-recording apparatus with a compact size is obtainable.

Ninth Exemplary Embodiment

Figure 13:
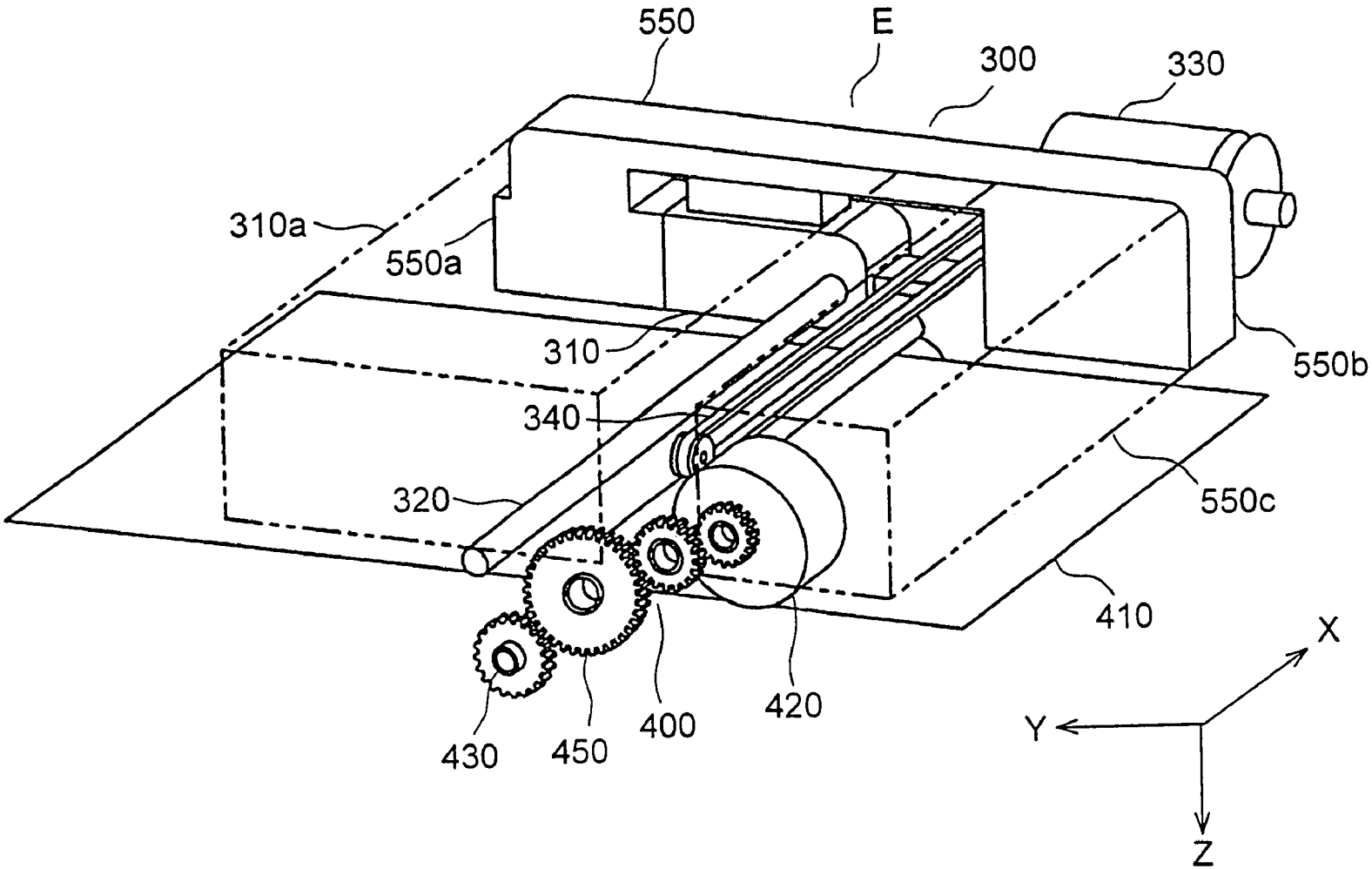
FIG. 13 is a perspective view of an inkjet recording apparatus in accordance with a ninth exemplary embodiment.

FIG. 13 is a perspective view of an inkjet recording apparatus in accordance with the ninth exemplary embodiment. The ninth embodiment differs from the fifth embodiment in the following point.

In the apparatus A, shown in FIG. 8, used in the fifth embodiment, the main tanks are placed between the carriage driving motor and the transfer motor. However, in ink-jet-recording apparatus E used in the ninth embodiment, shown in FIG. 13, the space between carriage the driving motor 330 and the transfer motor 420 is used as a tank moving space 550*c*. The ink tank 550 used in the ninth embodiment comprises the first tank 550*a* mounted to the carriage 310 and the second tank 550*b* provided in a transfer direction with respect to the first tank 550*a*. The second tank 550*b* is integrated into the first tank so that it communicates with the first tank 550*a*. The second tank 550*b* is disposed between both of the motors and on the same side that the carriage 310 is placed with respect to a transfer path. This structure allows the second tank 550*b* to reciprocate in the space 550*c*, while the first tank 550*a* reciprocates within the carriage-moving-space 310*a* following the reciprocation of the carriage 310.

The other structures of the apparatus E remain the same as that used in the fifth embodiment, and the same elements bear the same reference marks and the descriptions thereof are thus omitted here. In this ninth embodiment, since the ink-tank 550 has the first tank 550*a* and the second tank 550*b*, the total capacity is greater than those of previous embodiments. Further, the second tank 550*b* is placed between both of the motors, thus the capacity thereof can be large. Therefore, the apparatus E can be downsized in an ejection direction (Z axis direction) and the transfer direction (Y axis direction.) As a result, a high-speed recording apparatus can be downsized.

In the fifth through the ninth embodiments, the carriage driving motor 330 and the transfer motor 420 are disposed on the same side that the carriage 310 is placed with respect to the transfer path. However, it is not limited to this structure, and both of the motors can be placed above the transfer path in the Z axis direction viewed from a scanning direction (X axis direction.) In this case, the apparatus E can be downsized in the ejecting direction (Z axis direction.)

In the fifth through ninth embodiments, the carriage driving motor 330 is placed so that its rotary shaft faces toward the transfer direction. However, it is not limited to this structure, and the motor 330 can be placed so that the rotary shaft faces toward the scanning direction. In the same manner, the transfer motor 420 is placed so that its rotary shaft faces toward the scanning direction. However, the motor 420 can be placed so that the rotary shaft faces toward the transfer direction. Further, the locations of both of the motors can be exchanged with respect to the scanning direction.

As discussed above, the inkjet recording apparatuses in accordance with the fifth through the ninth embodiments prove that when the carriage driving motor and the transfer motor are disposed at approx. the same place in the ejecting direction (Z axis direction) and above the transfer path, or disposed on the same side as the carriage is placed in Z axis direction, the apparatuses can be downsized even if both the motors are in large shapes. Therefore, a high-speed and compact recording apparatus is obtainable. Further, when both the motors are away from each other in the scanning direction, and various elements forming the apparatus are disposed in the space between both the motors, the apparatus can be downsized in both the ejecting direction (Z axis direction) and the transfer direction (Y axis direction.)

High-speed recording and a compact size can be thus compatible in an inkjet recording apparatus.

Tenth Exemplary Embodiment

Figure 14:
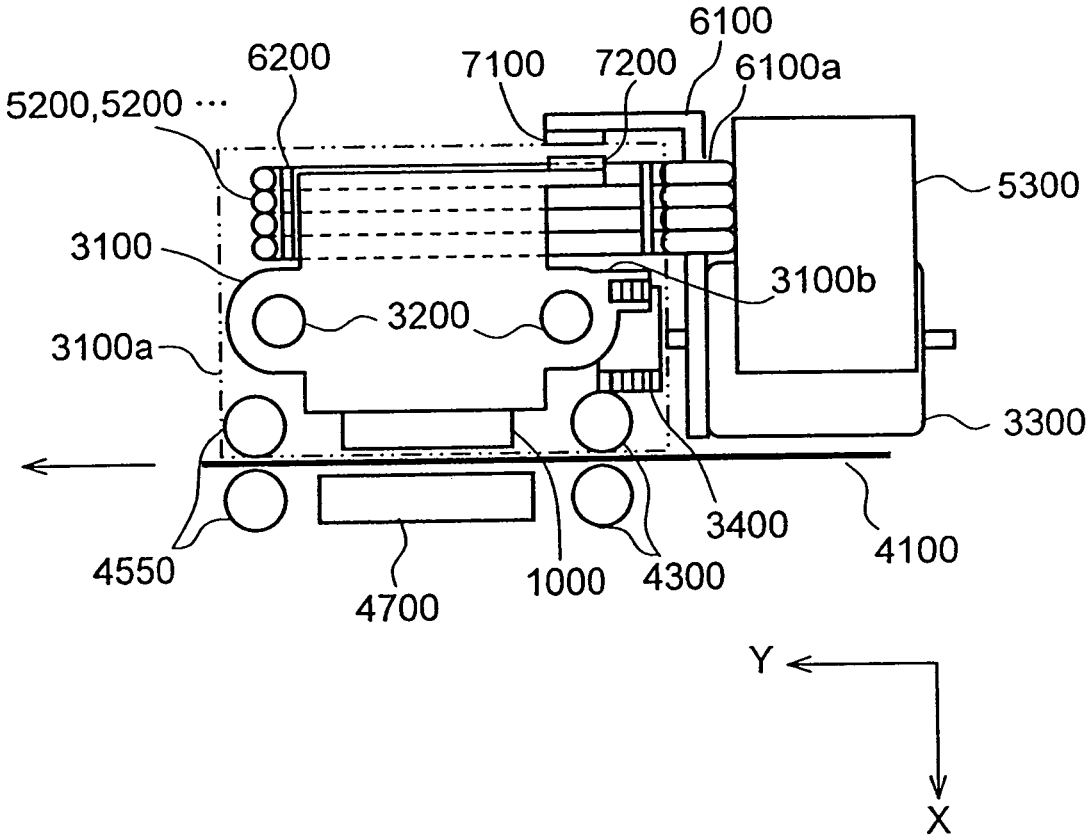
FIG. 14 is a lateral view of an inkjet recording apparatus in accordance with a tenth exemplary embodiment.
Figure 15:
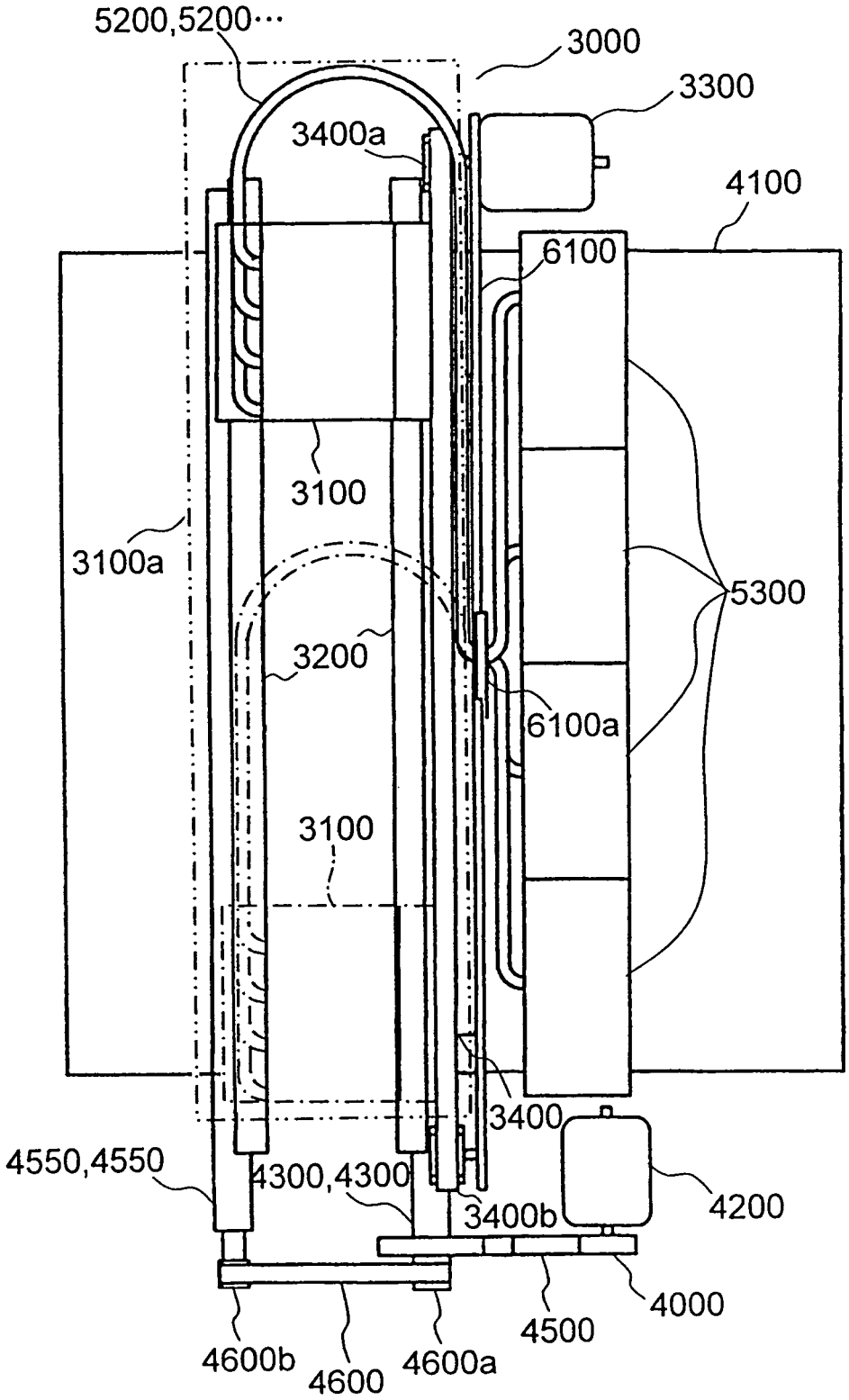
FIG. 15 is a plan view of the inkjet recording apparatus shown in FIG. 14.
Figure 16:
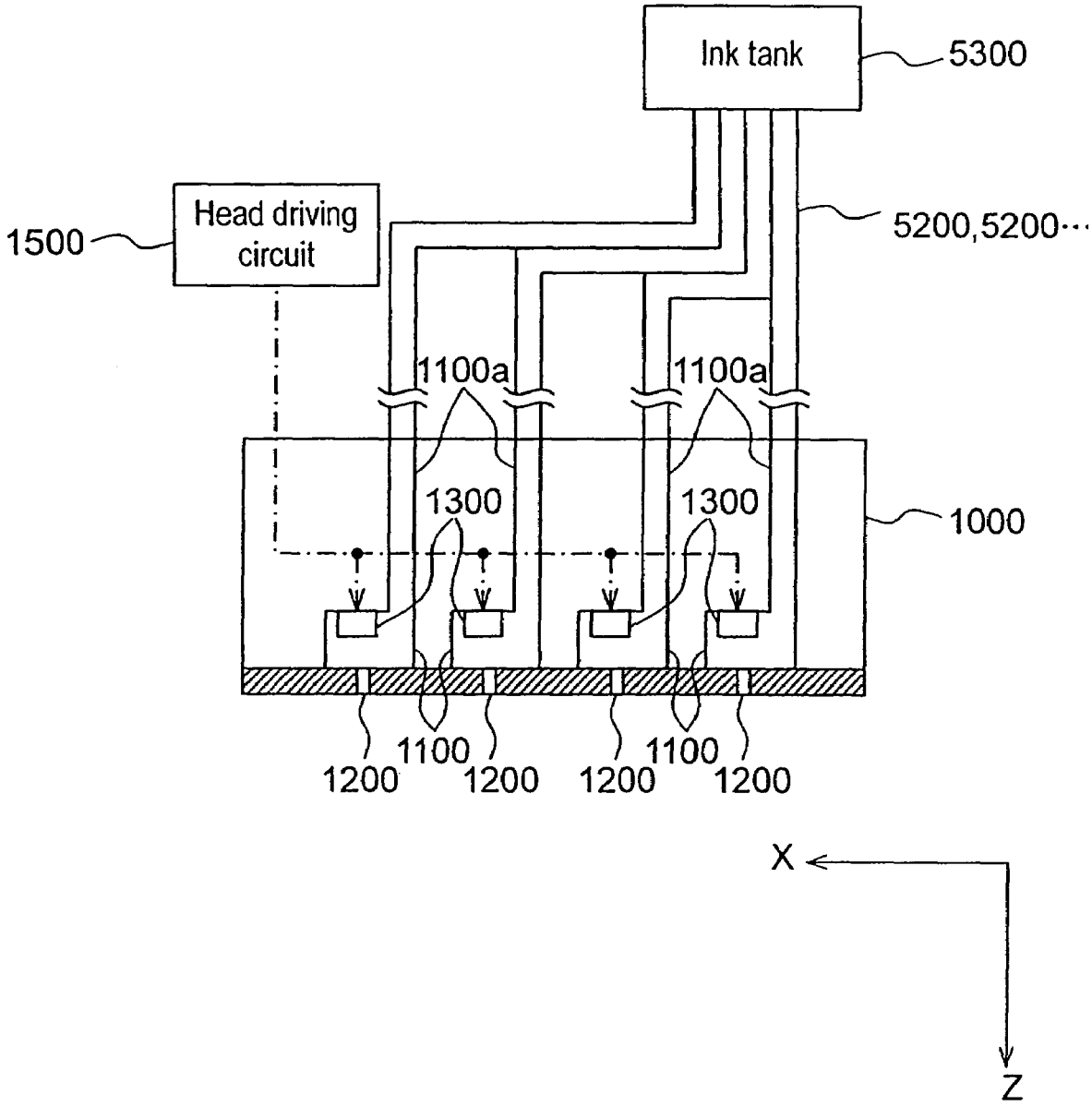
FIG. 16 is an enlarged view of recording heads of the apparatus shown in FIG. 14.
Figure 17:
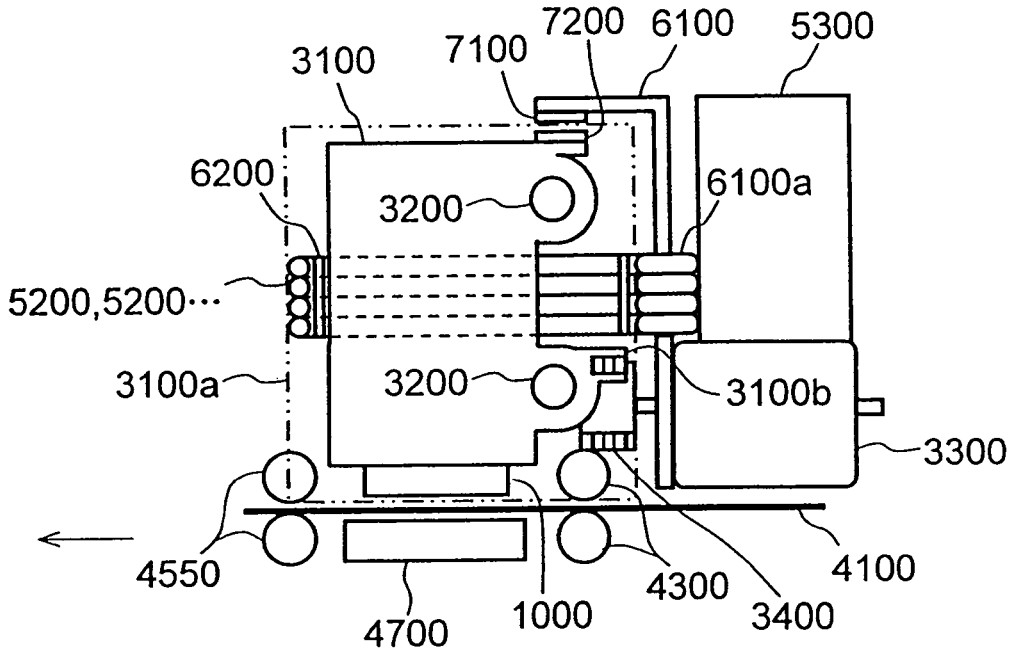
FIG. 17 is a lateral view of a first modification of the inkjet recording apparatus in accordance with the tenth embodiment.
Figure 18:
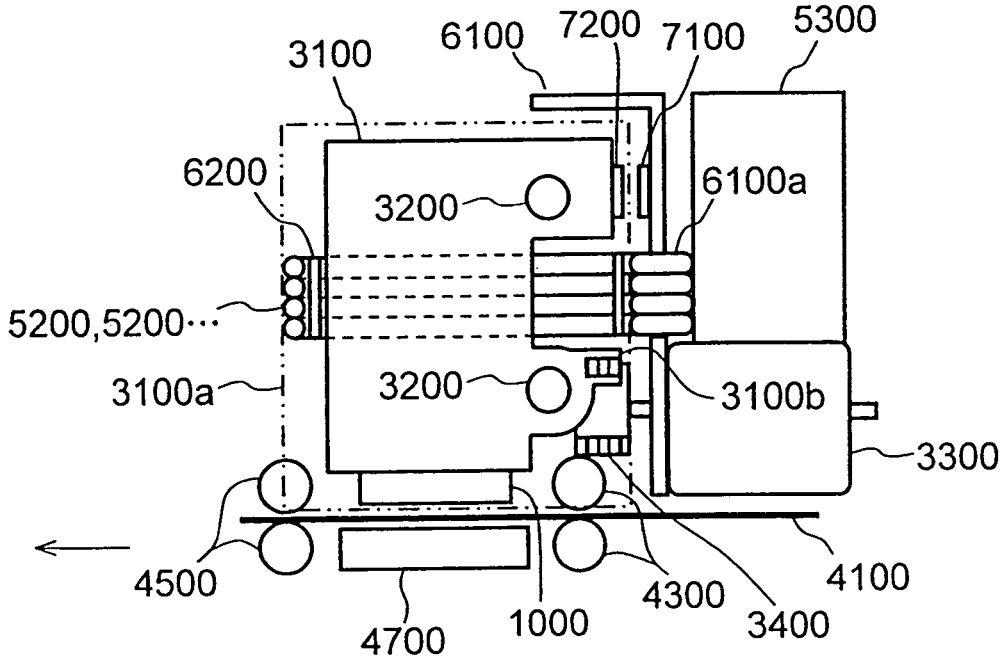
FIG. 18 is a lateral view of a second modification of the inkjet recording apparatus in accordance with the tenth embodiment.

FIG. 14 is a lateral view of an inkjet recording apparatus in accordance with the tenth exemplary embodiment. FIG. 15 is a plan view of the inkjet recording apparatus shown in FIG. 14. FIG. 16 is an enlarged view of recording heads of the apparatus shown in FIG. 14. FIG. 17 is a lateral view of a first modification of the inkjet recording apparatus in accordance with the tenth embodiment. FIG. 18 is a lateral view of a second modification of the inkjet recording apparatus.

In the apparatus used in the tenth embodiment shown in FIGS. 14 and 15, colored inks such as yellow, magenta, cyan and black are ejected from recording heads 1000 to a recording medium such as a sheet of paper 4100, so that color recording is carried out on the paper 4100.

The heads 1000 are disposed at a carriage 3100. A scanner 3000 reciprocates the carriage 3100 in a scanning direction (X direction.) A transfer machine 4000 transfers the paper 4100 in a transfer direction (Y direction) perpendicular to the scanning direction.

A carriage-moving-space 3100*a*, for the carriage 3100 to reciprocate in the scanning direction, extends in the scanning direction. The carriage 3100 reciprocates within the space 3100*a* in the scanning direction, so that the head 1000 also reciprocates in the scanning direction. The scanner 3000 comprises a pair of carriage shafts 3200 for guiding the carriage 3100, a carriage driving motor 3300, and a carriage driving belt 3400 for transferring the carriage 3100. This pair of carriage shafts 3200 extend in the scanning direction and are disposed in parallel with the transfer direction. The pair of shafts 3200 extend through and guide the carriage 3100, so that the carriage 3100 moves along the pair shafts 3200.

The belt 3400 winds on a driver pulley 3400*a* and a follower pulley 3400*b* spaced from each other in the scanning direction. The motor 3300 is adjacent to the space 3100*a* with respect to the transfer direction and disposed on a first side of the scanning direction. As shown in FIG. 14, the motor 3300 is disposed on the side of the carriage 3100 with respect to the transfer path, i.e., upstream side in the ink ejecting direction with respect to the transfer path (Z direction shown in FIG. 14). The pulley 3400*a* is mounted to a rotary shaft of the motor 3300, and spinning of the motor 3300 causes the pulley 3400*a* to spin. The spin of the pulley 3400*a* is transferred to the pulley 3400*b* via the belt 3400.

On the carriage 3100, engaging section 3100*b* for engaging with belt 3400 is formed. When belt 3400 is driven, an engaging section 3100*b* is moved by the belt 3400. Therefore, the rotary shaft of the motor 3300 is normally driven or reversedly driven, so that the carriage 3100 reciprocates in the scanning direction.

A frame 6100, of which cross sectional view shapes in a reversed letter "L", is placed such that it extends in the scanning direction between the space 3100*a* and the motor 3300, and defines the space 3100*a*. At the bent section on the upper end of the frame 6100, a linear scale 7100 is disposed for detecting a position of the carriage 3100 with respect to the scanning direction. In other words, the scale 7100 is located above the carriage 3100 and extends in the scanning direction.

On the other hand, on the upper face of the carriage 3100, a detecting sensor 7200 is disposed. The sensor 7200 faces the linear scale 7100 to detect it. The sensor 7200 detects a position of the carriage 3100 in the scanning direction, and based on this detected position, rotational control of the motor 3300 is performed.

The transfer machine 4000 comprises a transfer motor 4200, which is a driving source for transferring the recording paper 4100, a pair of transfer rollers 4300 for pinching the paper 4100 for transfer, and a pair of discharging rollers 4550 for pinching and discharging the paper 4100. The motor 4200 is disposed at a place adjacent to the space 3100*a* and on a second side of the scanning direction. In other words, as shown in FIG. 15, the motor 4200 is away from the motor 3300 in the scanning direction (X direction.) The pair of rollers 4300 facing each other extend, respectively, in the scanning direction. One of the rollers 4300 is coupled to a rotating shaft of the motor 4200 via a plurality of gears 4500. Thus, this roller 4300 rotates around the motor shaft following the rotation of the shaft of the motor 4200.

The pair of discharging rollers 4550, facing each other, extend respectively, in the scanning direction, and are disposed in parallel with the pair of rollers 4300 in the transfer direction. Pulleys 4600*a* and 4600*b* are disposed, respectively, at the end of one of the pair of rollers 4300 and pair-rollers 4550. This pair of pulleys have the same diameter, and a transmission belt 4600 winds on these pulleys. This structure allows the roller 4550 to rotate by the belt 4600 at the same rotating speed and in the same direction as the roller 4300, simultaneously.

Accordingly, when the motor 4200 spins, the paper 4100 pinched by the pair of rollers 4300 is transferred to just under the heads 1000, while another piece of the paper 4100 pinched by the pair-rollers 4550 is discharged from just under the heads 1000 in the transfer direction.

Between the rollers 4300 and the rollers 4550, a platen 4700 is disposed on the reverse side of the head 1000 with respect to the paper 4100, so that wrinkles or looseness of the paper 4100 can be prevented. Thus, a quality picture can be recorded.

Recording heads 1000 disposed to the carriage 3100, as shown in FIG. 16, comprise a plurality of pressuring chambers 1100 in which colored inks such as yellow, magenta, cyan and black are filled, a plurality of nozzle-holes 1200 disposed on walls defining the respective chambers 1100, and for ejecting the inks from the chambers 1100, and actuators 1300 actuating and deforming so that capacities of the respective chambers 1100 decrease.

Ink flow-paths 1100*a*, through which the ink is supplied, communicate with the chambers 1100. These paths 1100*a* are coupled to a ink-tank 5300 via ink-supplying-tubes 5200.

The actuators 1300 is disposed on the walls of the chambers 1100 facing the walls on which the nozzle-holes 1200 are formed. The actuators 1300 are formed by piezoelectric film pinched by a pair of electrodes. A pulse is applied over the pair of electrodes, and a rise of pulse voltage makes the actuator 1300 bow downward (protrudes inside of the chamber 1100) due to the bimetal effect. This deflection ejects the ink in the chamber 1100 through the nozzle-hole 1200 to the paper 4100. On the other hand, a fall of pulse voltage restores the actuator 1300, then ink is filled in the chamber 1100 through the flow path 1100*a*.

The voltage applied to the actuator 1300 is controlled by a head driving circuit 1500. The driving circuit 1500 controls the deforming of the actuator 1300, so that ejection of the ink is controlled. The ink tanks 5300 accommodate respective colored ink independently, and are aligned in the scanning direction at a place adjacent to the space 3100*a* in the transfer direction, as shown in FIGS. 14 and 15. Thus, the tanks 5300 are located on the same side as the motor 3300 with respect to the space 3100*a*. As such, the four tanks 5300 are aligned in the scanning direction, thereby increasing respective capacities of the tanks 5300.

The tubes 5200 are provided to respective colored inks, and the four tubes 5200 are aligned in the ejecting direction (Z axis direction) and integrated into one unit. The tubes 5200 are coupled to the carriage 3100 on the other side of the tanks 5300 with respect to the transfer direction, and bowed upward in the space 3100*a* and arrive at the tanks 5300 on their sides closer to the space 3100*a*. The tubes 5200 are routed outside of the space 3100*a* via a coupling section 6100*a* which is disposed at approximately the center of a frame 6100 in the scanning direction and above the carriage shaft 3200 as well as carriage the driving belt 3400 in the ejecting direction (Z axis direction). Thus, the tubes 5200 run above the carriage shaft 3200 and the belt 3400. Outside of the space 3100*a*, the tubes 5200 are separated to respective colors and coupled to the four tanks 5300, independently.

Among a plurality of ink tanks 5300, an ink tank, which contains the ink of the highest viscosity, is placed closest to the coupling section 6100*a*, i.e., at the middle in the scanning direction (X axis direction.) The highest viscosity ink is, for instance, an ink of pigment system.

A tank containing the most consumable ink may be disposed closest to the coupling section 6100*a*. The most consumable ink is usually black ink. From the coupling section 6100*a* to the carriage 3100, electric wiring 6200, including power lines and others, is integrally routed along the tubes 5200. The wiring 6200 is coupled to the driving circuit 1500 of the carriage 3100.

An operation and advantages of the tenth embodiment are demonstrated hereinafter.

Since the ink-supplying-tubes 5200 are routed through the carriage moving space 3100*a*, no additional space for the tubes 5200 is specifically required. As a result, the apparatus can be downsized.

The tubes 5200 reciprocate within the space 3100*a* following the reciprocation of the carriage 3100. At this time, the tubes 5200 do not interfere with the reciprocation of the carriage 3100 and vice versa. (Refer to chain lines in FIG. 15.) As a result, the ink is supplied to the recording heads 1000 supplied in a stable manner.

Further, the ink tanks 5300 and the carriage driving motor 3300 are placed on the same side as the space 3100*a* with respect to the transfer direction (Y axis direction), thus the apparatus can be downsized in the transfer direction.

Still further, the tanks 5300 are disposed close to the carriage 3100, therefore, the length of the tubes 5200 becomes short. As a result, flow-path resistance against the ink becomes less, thus the ink can be supplied to the recording heads 1000 in a stable manner.

The ink tank 5300, containing the ink of the highest viscosity or the most consumable ink, is disposed at the middle of the tanks 5300 in the scanning direction (X axis direction), thus the ink can be supplied with the shorter tube length to the head 1000. As a result, flow path resistance against the ink becomes less, and the apparatus achievable of stable recording can be obtained.

Further, the coupling section 6100*a* is placed approximately at the center of the frame 6100 in the scanning direction (X axis direction), so that a flowing length of the tube 5200 disposed in the space 3100*a* can be minimized. The flowing lengths of the tubes 5200 between the coupling section 6100*a* and respective tanks can be approximately equal to each other. As a result, inks contained in any tanks can be supplied to the heads 1000 in a stable manner. In addition, the tubes 5200 are coupled to the carriage 3100 at a distant side in the transfer direction with respect to the tanks 5300, which gives the tubes 5200 greater curvatures, and flow-path resistance against the ink decreases. As a result, the inks can be supplied to the heads 1000 in a stable manner.

The electric wiring 6200 is routed integrally with the tubes 5200, so that no additional space is required for the wiring 6200. As a result, the apparatus can be further downsized, and the electric wiring 6200 does not interfere with the moving of the carriage 3100 and the tubes 5200.

First Modification

FIG. 17 illustrates an inkjet recording apparatus in accordance with the first modification. In this modification, the carriage shaft 3200 is disposed at a different place from the tenth embodiment. To be more specific, in this modification, a pair of carriage shafts 3200 are disposed in the ejecting direction (Z axis direction), and a pair of the ink-supplying-tubes 5200 are routed between the pair of carriage shafts 3200.

The other elements and structures are the same as those in the tenth embodiment, and the same elements are denoted with the same reference marks. The descriptions thereof are, thus, omitted here. In this modification, no additional space is required for the routing tubes 5200, which are routed in an optimum manner, so that the inks can be supplied to the heads 1000 in a stable manner.

Second Modification

FIG. 18 illustrates an inkjet recording apparatus in accordance with the second modification. In the second modification, a linear scale 7100 is disposed at a different place from the first modification. To be more specific, the scale 7100 is disposed on the depending wall of the frame 6100, i.e., disposed at the carriage 3100 on the side of the transfer direction, and a detecting sensor 7200, which detects the scale 7100, is disposed on the side of the carriage 3100 closer to the tanks 5300.

The other elements and structure are the same as those in the tenth embodiment, and the same elements are denoted with the same reference marks. The descriptions thereof are, thus, omitted here. The carriage shafts 3200, the linear scale 7100 and the carriage driving belt 3400 are, thus, placed so as not to interfere with the tubes 5200.

11th Exemplary Embodiment

Figure 19:
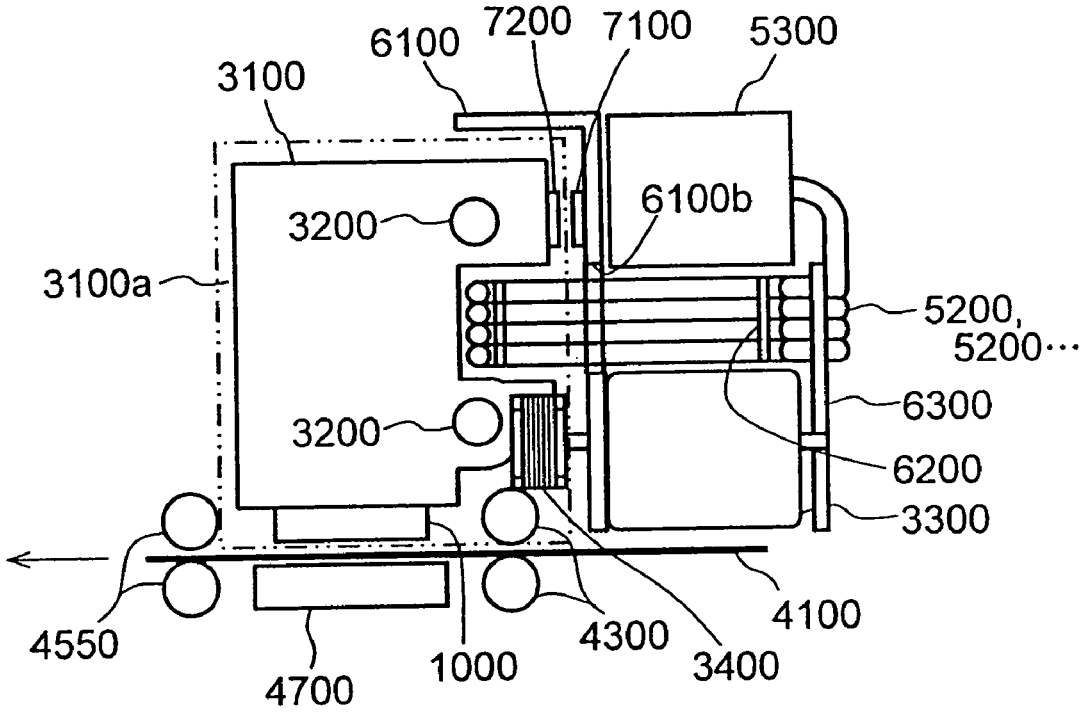
FIG. 19 is a lateral view of an inkjet recording apparatus in accordance with a eleventh exemplary embodiment.
Figure 20:
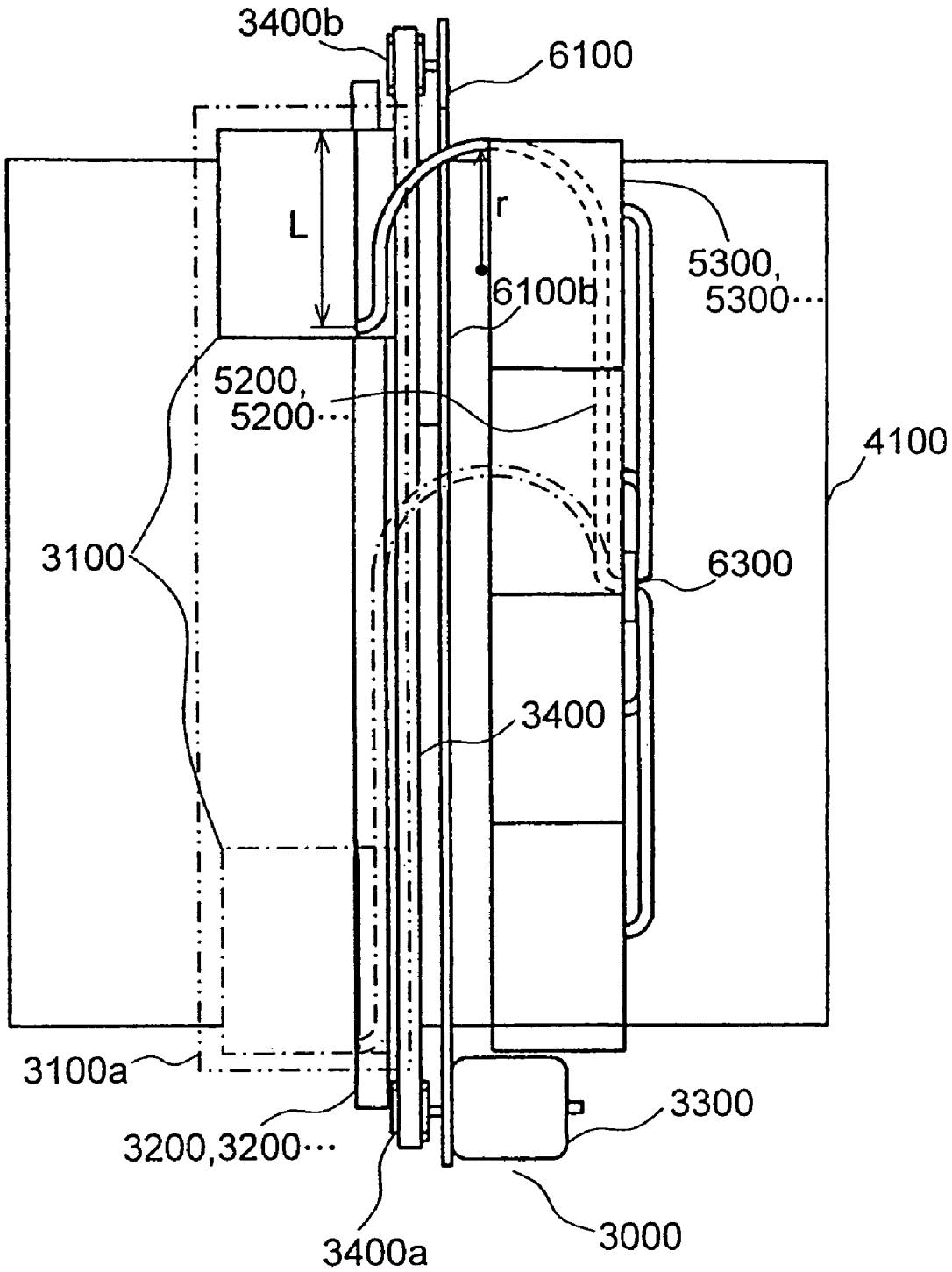
FIG. 20 is a plan view of the inkjet recording apparatus in accordance with the eleventh exemplary embodiment.

FIG. 19 is a lateral view of an inkjet recording apparatus in accordance with the 11th exemplary embodiment. FIG. 20 is a plan view of the same inkjet recording apparatus.

This 11th embodiment tries downsizing the apparatus in a scanning direction. In FIG. 20, a plus side in the X direction is referred to as a first side of the scanning direction, and a minus side thereof is a second side of the scanning direction. The minus side in the Y direction is referred to as a first side of the transfer direction, and a plus side thereof is a second side of the transfer direction.

In the 11th embodiment, the ink-supplying-tubes 5200 are coupled to the carriage 3100 on its first side of the transfer direction (Y axis direction.) The tubes 5200 are routed through a slit 6100*b* formed on the frame 6100 and extending in the scanning direction (X axis direction), and adjacent to the carriage moving space 3100*a* on the first side of the transfer direction (Y axis direction.) Thus, the tubes 5200 bow upward (protrude) to the first side of the scanning direction.

The tubes 5200 are coupled to the carriage 3100 in parallel with an ejecting direction (Z axis direction.) The coupling section of the tubes 5200 to the carriage 3100 is set on the second side of the scanning direction on the carriage 3100, as shown in FIG. 20. The distance "L" between an end of the first side of the scanning direction on the carriage 3100 and the coupling section is longer than a curvature diameter "r" of the bowed section of the tubes 5200.

The tanks 5300 are placed adjacent to the space 3100*a* on the first side of the transfer direction (Y axis direction), and are disposed on the upstream side with respect to the tubes 5200 in the ejecting direction (Z axis direction.) The tubes 5200 are routed under the tanks 5300 in the ejecting direction, and coupled to the side of the respective tanks 5300 on the first side of the transfer direction via coupling sections 6300 apart from each other on the first side of the frame 6100 in the transfer direction. The coupling sections are located approximately at the center in the scanning direction (X axis direction.)

The carriage driving motor 3300 of the scanner 3000 is placed on the second side of the scanning direction (X axis direction), which differs from the tenth embodiment. In FIG. 20, the transfer machine 4000 is omitted; however, other structures, including the transfer machine 4000, are the same as that in the tenth embodiment. Thus, the same elements are denoted with the same reference marks and the descriptions thereof are, thus, omitted here.

In this 11th embodiment, the tubes 5200 are bowed at the place adjacent to the space 3100*a* on the first side of the transfer direction (Y axis direction), therefore, the tubes 5200 can have a rather large curvature diameter "r". As a result, flow path resistance against the ink is lowered and the ink can be supplied in a stable manner.

The coupling section of the tubes 5200 to the carriage 3100 is set on the second side of the scanning direction with reference to an end of the first side of the scanning direction on the carriage 3100 exceeding the curvature radius "r" (refer to distance "L" in FIG. 20.) Thus, when the carriage 3100 is moved to the end of the first side of the scanning direction in the space 3100*a*, the tubes 5200 bow at the place adjacent to the carriage 3100 on the first side of the transfer direction. The top of the bowed section will not extend in the scanning direction (X axis direction) from the first side of the scanning direction on the carriage 3100 (refer to solid lines in FIG. 20.) In other words, the tubes 5200 are placed on the second side of the scanning direction from the end of the first side of the scanning direction on the carriage 3100. As a result, the inkjet recording apparatus can be downsized in the scanning direction (X axis direction.)

The ink tanks 5300 are placed at the place adjacent to the space 3100*a* on the first side of the transfer direction, and placed on the upstream side of the ejecting direction (Z axis direction) with respect to the tubes 5200. Thus, the tanks 5300 are layed over the tubes 5200 viewed from the ejecting direction (Z axis direction.) As a result, the apparatus can be downsized both in the scanning direction (X axis direction) and in the transfer direction (Y axis direction.)

The tanks 5300 are disposed in the vicinity of the carriage 3100, therefore, the length of the flow path of the tube 5200 can be shorter, and the ink can be supplied in a stable manner.

The present invention is not limited to the 10th and 11th embodiments, and various modifications are available. To be more specific, in the 10th embodiment, the ink-supplying-tubes 5200 are coupled to the carriage 3100 at the side distant from the tanks 5300 in the transfer direction. However, the coupling section is not limited to this.

In the 11th embodiment, the tanks 5300 are placed on the upstream side of the tubes 5200 in the ejecting direction. However, the tanks 5300 can be placed on the downstream side of the tubes 5200.

Further in the 11th embodiment, the tubes 5200 are placed on the second side of the scanning direction from the first side thereof on the carriage 3100. However, the tubes 5200 can be placed a little bit outside from the end of the first side of the scanning direction on the carriage 3100.

Still further, in the 10th and 11th embodiments, sub-tanks can be provided to the carriage 3100 for temporary pooling of the inks supplied from the tanks 5300, the sub-tanks may be placed between the tanks 5300 and the heads 1000.

As discussed above, according to the apparatuses described in the 10th and 11th embodiments, the ink-supplying-tubes are routed through the carriage moving space, therefore, no additional space is specifically required for the tubes. As a result, the apparatus can be downsized.

The tubes are routed so that the flow-path length can be shorter and flow-path resistance against the ink can be lowered. As a result, the ink can be supplied to the heads in a stable manner.

Further, the ink-supplying-tubes are bowed and placed at the place adjacent to the carriage moving space on the first side of the transfer direction. This structure allows the tubes to have a larger curvature diameter, which realizes stable ink supply to the heads. At the same time, the coupling section of the tubes to the carriage is located on the carriage on the second side of the scanning direction from the first side thereof, so that the apparatus can be downsized particularly in the scanning direction.

What is claimed is:

1. An inkjet recording apparatus comprising:

a plurality of recording heads having nozzles, said plurality of recording heads being provided to a carriage and being operable to eject a plurality of colored inks from said nozzles;

a plurality of first ink tanks operable to pool the plurality of colored inks, respectively, said plurality of first ink tanks being provided on the carriage;

a plurality of second ink tanks operable to pool the plurality of colored inks, respectively, said plurality of second ink tanks being separate from said plurality of first ink tanks; and a plurality of ink supply passages for supplying the plurality of colored inks to said plurality of first ink tanks from said plurality of second ink tanks, respectively, wherein at least one ink supply passage of said plurality of ink supply passages for a predetermined colored ink is operable to supply the predetermined colored ink to one recording head of said plurality of recording heads in a greater amount per unit time than other ink supply passages of said plurality of ink supply passages supply other colored inks to a remainder of said plurality of recording heads.

2. An inkjet recording apparatus according to claim 1, wherein said plurality of ink supply passages are tubes.

3. An inkjet recording apparatus comprising:

a plurality of recording heads having nozzles, said plurality of recording heads being provided to a carriage and being operable to eject a plurality of colored inks from said nozzles;

a plurality of ink tanks adapted to store the plurality of colored inks, respectively, said plurality of ink tanks being located separate from the carriage; and a plurality of ink supply passages for supplying the plurality of colored inks to said plurality of recording heads from said plurality of ink tanks, respectively, wherein at least one ink supply passage of said plurality of ink supply passages for a predetermined colored ink has a larger cross section than other ink supply passages of said plurality of ink supply passages for other colored inks.

4. An inkjet recording apparatus according to claim 3, wherein said plurality of ink supply passages are tubes.

5. An inkjet recording apparatus comprising:

a plurality of recording heads having nozzles, said plurality of recording heads being provided to a carriage and being operable to eject a plurality of colored inks from said nozzles;

a plurality of ink tanks adapted to store the plurality of colored inks, respectively, said plurality of ink tanks being located separate from the carriage; and a plurality of ink supply passages for supplying the plurality of colored inks to said plurality of recording heads from said plurality of ink tanks, respectively, wherein at least one ink supply passage of said plurality of ink supply passages for a predetermined colored ink has a larger diameter than other ink supply passages of said plurality of ink supply passages for other colored inks.

6. An inkjet recording apparatus according to claim 5, wherein said plurality of ink supply passages are tubes.

7. An inkjet recording apparatus comprising:

a plurality of recording heads having nozzles, said plurality of recording heads being provided to a carriage and being operable to eject a plurality of colored inks from said nozzles;

a plurality of first ink tanks operable to pool the plurality of colored inks, respectively, said plurality of first ink tanks being provided on the carriage;

a plurality of second ink tanks operable to pool the plurality of colored inks, respectively, said plurality of second ink tanks being separate from said plurality of first ink tanks; and a plurality of ink supply passages for supplying the plurality of colored inks to said plurality of first ink tanks from said plurality of second ink tanks, respectively, wherein at least one ink supply passage of said plurality of ink supply passages for a predetermined colored ink has a larger cross section than other ink supply passages of said plurality of ink supply passages for other colored inks.

8. An inkjet recording apparatus comprising:

a plurality of recording heads having nozzles, said plurality of recording heads being provided to a carriage and being operable to eject a plurality of colored inks from said nozzles;

a plurality of first ink tanks operable to pool the plurality of colored inks, respectively, said plurality of first ink tanks being provided on the carriage;

a plurality of second ink tanks operable to pool the plurality of colored inks, respectively, said plurality of second ink tanks being separate from said plurality of first ink tanks; and a plurality of ink supply passages for supplying the plurality of colored inks to said plurality of first ink tanks from said plurality of second ink tanks, respectively, wherein at least one ink supply passage of said plurality of ink supply passages for a predetermined colored ink has a larger diameter than other ink supply passages of said plurality of ink supply passages for other colored inks.

9. An inkjet recording apparatus comprising:

a plurality of recording heads having nozzles, said plurality of recording heads being operable to eject a plurality of liquids from said nozzles;

a plurality of liquid tanks operable to pool the plurality of liquids, respectively; and a plurality of liquid supply passages for supplying the plurality of liquids to said plurality of recording heads from said plurality of liquid tanks, wherein at least one liquid supply passage of said plurality of liquid supply passages for a predetermined liquid has a larger cross section than other liquid supply passages of said plurality of liquid supply passages for other liquids.

10. An inkjet recording apparatus comprising:

a plurality of recording heads having nozzles, said plurality of recording heads being operable to eject a plurality of liquids from said nozzles;

a plurality of liquid tanks operable to pool the plurality of liquids, respectively; and a plurality of liquid supply passages for supplying the plurality of liquids to said plurality of recording heads from said plurality of liquid tanks, wherein at least one liquid supply passage of said plurality of liquid supply passages for a predetermined liquid has a larger diameter than other liquid supply passages of said plurality of liquid supply passages for other liquids.

11. An inkjet apparatus according to claim 9, wherein a viscosity of the predetermined liquid is greater than the other liquids.

12. An inkjet apparatus according to claim 10, wherein a viscosity of the predetermined liquid is greater than the other liquids.

13. An inkjet recording apparatus comprising:

a plurality of recording heads having nozzles, and being operable to eject a plurality of liquids from said nozzles;

a plurality of first liquid tanks operable to pool the plurality of liquids, respectively, said plurality of first liquid tanks being adjacent to said plurality of recording heads;

a plurality of second liquid tanks operable to pool the plurality of liquids, respectively, said plurality of second liquid tanks being separate from said plurality of first liquid tanks; and a plurality of liquid supply passages for supplying the plurality of liqiuids to said plurality of first liquid tanks from said plurality of second liquid tanks, respectively, wherein at least one liquid supply passage of said plurality of liquid supply passages for a predetermined liquid is operable to supply the predetermined liquid to one recording head of said plurality of recording heads in a greater amount per unit time than other liquid supply passages of said plurality of liquid supply passages supply other liquids to a remainder of said plurality of recording heads.

14. An inkjet recording apparatus comprising:

a plurality of recording heads having nozzles, and being operable to eject a plurality of liquids from said nozzles;

a plurality of first liquid tanks operable to pool the plurality of liquids, respectively;

a plurality of second liquid tanks operable to pool the plurality of liquids, respectively, said plurality of second liquid tanks being separate from said plurality of first liquid tanks; and a plurality of liquid supply passages for supplying the plurality of liquids to said plurality of first liquid tanks from said plurality of second liquid tanks, respectively, wherein at least one liquid supply passage of said plurality of liquid supply passages for a predetermined liquid has a larger cross section than other liquid supply passages of said plurality of liquid supply passages for other liquids.

15. An inkjet recording apparatus comprising:

a plurality of recording heads having nozzles, and being operable to eject a plurality of liquids from said nozzles;

a plurality of first liquid tanks operable to pool the plurality of liquids, respectively;

a plurality of second liquid tanks operable to pool the plurality of liquids, respectively, said plurality of second liquid tanks being separate from said plurality of first liquid tanks; and a plurality of liquid supply passages for supplying the plurality of liquids to said plurality of first liquid tanks from said plurality of second liquid tanks, respectively, wherein at least one liquid supply passage of said plurality of liquid supply passages for a predetermined liquid has a larger diameter than other liquid supply passages of said plurality of liquid supply passages for other liquids.

* * * * *